US010748516B2

(12) United States Patent
Vilkamo et al.

(10) Patent No.: US 10,748,516 B2
(45) **Date of Patent: *Aug. 18, 2020**

(54) OPTIMAL MIXING MATRICES AND USAGE OF DECORRELATORS IN SPATIAL AUDIO PROCESSING

(71) Applicant: Fraunhofer-Gesellschaft zur Foerderung der angewandten Forschung e.V., Munich (DE)

(72) Inventors: Juha Vilkamo, Helsinki (FI); Tom Baeckstroem, Nuremberg (DE); Fabian Kuech, Erlangen (DE); Achim Kuntz, Hemhofen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/388,713

(22) Filed: Apr. 18, 2019

(65) Prior Publication Data

US 2019/0251938 A1 Aug. 15, 2019

Related U.S. Application Data

(63) Continuation of application No. 14/180,230, filed on Feb. 13, 2014, now Pat. No. 10,339,908, which is a (Continued)

(30) Foreign Application Priority Data

Feb. 21, 2012 (EP) ..... 12156351

(51) Int. Cl.

| | |
|---|---|
| ***G10H 1/18*** | (2006.01) |
| ***G10L 19/008*** | (2013.01) |
| ***G10L 19/00*** | (2013.01) |

(52) U.S. Cl.
CPC ..... *G10H 1/183* (2013.01); *G10L 19/008* (2013.01)

(58) Field of Classification Search
None
See application file for complete search history.

(56) References Cited

U.S. PATENT DOCUMENTS

2006/0165237 A1 7/2006 Villemoes et al.
2008/0205657 A1 8/2008 Oh et al.
(Continued)

FOREIGN PATENT DOCUMENTS

CN 101411214 A 4/2009
CN 101542595 A 9/2009
(Continued)

OTHER PUBLICATIONS

Faller, Christof, "Multiple-Loudspeaker Playback of Stereo Signals", Journal of Audio Engineering Society, vol. 54, No. 11, Nov. 2006, pp. 1051-1064.
(Continued)

*Primary Examiner* — Qin Zhu
(74) *Attorney, Agent, or Firm* — Michael A. Glenn; Perkins Coie LLP

(57) ABSTRACT

An apparatus for generating an audio output signal is provided. The audio output signal has two or more audio output channels and is generated from an audio input signal having two or more audio input channels. The apparatus includes a provider and a signal processor. The provider is adapted to provide first covariance properties of the audio input signal. The signal processor is adapted to generate the audio output signal by applying a mixing rule on at least two of the two or more audio input channels. The signal processor is configured to determine the mixing rule based on the first covariance properties of the audio input signal and
(Continued)

based on second covariance properties of the audio output signal, the second covariance properties being different from the first covariance properties.

26 Claims, 15 Drawing Sheets

Related U.S. Application Data continuation of application No. PCT/EP2012/065861, filed on Aug. 14, 2012.

(60) Provisional application No. 61/524,647, filed on Aug. 17, 2011.

(56) References Cited

U.S. PATENT DOCUMENTS

| | | | |
|---|---|---|---|
| 2009/0110203 | A1 | 4/2009 | Taleb |
| 2009/0125313 | A1 | 5/2009 | Hellmuth et al. |
| 2010/0094631 | A1 | 4/2010 | Engdegard et al. |
| 2010/0153097 | A1 | 6/2010 | Hotho et al. |
| 2010/0254539 | A1 | 10/2010 | Jeong et al. |
| 2011/0137662 | A1 | 6/2011 | McGrath et al. |
| 2014/0297294 | A1 | 10/2014 | Kim et al. |

FOREIGN PATENT DOCUMENTS

| | | | |
|---|---|---|---|
| CN | 101821799 | A | 9/2010 |
| EP | 2146522 | A1 | 1/2010 |
| JP | 2005136709 | A | 5/2005 |
| JP | 2010525403 | A | 7/2010 |
| KR | 1020100003352 | A | 1/2010 |
| RU | 2407073 | C2 | 12/2010 |
| TW | 201117193 | A | 5/2011 |
| TW | 201120874 | A | 6/2011 |
| WO | 2007/111568 | A2 | 10/2007 |
| WO | 2008/131903 | A1 | 11/2008 |
| WO | 2010/086462 | A2 | 8/2010 |
| WO | 2011/039195 | A1 | 4/2011 |

OTHER PUBLICATIONS

Breebaart, et al., "Parametric Coding of Stereo Audio", Journal on Applied Signal Processing, EURASIP, 2005, pp. 1305-1322.

Golub, et al., "Matrix Computations", Johns Hopkins Univ Press, 1996, 367 pages.

Herre, et al., "MPEG Surround—The ISO/MPEG Standard for Efficient and Compatible Multichannel Audio Coding", J. Audio Eng. Soc., vol. 56, No. 11, Nov. 2008, pp. 932-955.

Pulkki, "Spatial Sound Reproduction with Directional Audio Coding", J. Audio Eng. Soc., Helsinki Univ. of Technology, Finland; 55(6), Jun. 2007, pp. 503-516.

Rebonato, et al., "The most general methodology to create a valid correlation matrix for risk management and option pricing purposes", Journal of Risk, vol. 2, No. 2, Oct. 1999, pp. 17-28.

Seefeldt, et al., "New Techniques in Spatial Audio Coding", Audio Engineering Society Convention Paper 6587, presented at the 119th Convention; New York, NY, Oct. 2005, 13 pages.

Tournery, et al., "Converting Stereo Microphone Signals Directly to MPEG-Surround", Audio Engineering Society Convention Paper 7982, Presented at the 128th Convention, London, UK May 2010.

Vilkamo, J et al., "Directional Audio Coding: Virtual Microphone-Based Synthesis and Subjective Evaluation", AES. vol. 57, No. 9, Sep. 2009, pp. 709-724.

| Context | $C_x$ |
|---|---|
| Decorrelation : High input ICC | $\begin{bmatrix} 1 & 0.8 \\ 0.8 & 1 \end{bmatrix}$ |
| Decorrelation: Very high input ICC | $\begin{bmatrix} 1 & 0.97 \\ 0.97 & 1 \end{bmatrix}$ |
| Stereo upmixing | $\begin{bmatrix} 2 & 1 \\ 1 & 2 \end{bmatrix}$ |
| 5.0 to 7.0 upmixing | $\begin{bmatrix} 1 & 0 & 0 & 0 & 0 \\ 0 & 1 & 0 & 0 & 0 \\ 0 & 0 & 1 & 0 & 0 \\ 0 & 0 & 0 & 1 & 0 \\ 0 & 0 & 0 & 0 & 1 \end{bmatrix}$ |
| Downmixing: with same non-zero coherence | $\begin{bmatrix} 1 & 0 & 0 & 0.5 & 0 \\ 0 & 1 & 0 & 0 & 0.5 \\ 0 & 0 & 1 & 0 & 0 \\ 0.5 & 0 & 0 & 1 & 0 \\ 0 & 0.5 & 0 & 0 & 1 \end{bmatrix}$ |
| Decorrelation: 5.0 equal-spaced coincident cardioid | $\begin{bmatrix} 1 & 0.86 & 0.64 & 0.64 & 0.86 \\ 0.86 & 1 & 0.86 & 0.64 & 0.64 \\ 0.64 & 0.86 & 1 & 0.86 & 0.64 \\ 0.64 & 0.64 & 0.86 & 1 & 0.86 \\ 0.86 & 0.64 & 0.64 & 0.86 & 1 \end{bmatrix}$ |
| Decorrelation: 5.0 standard layout coincident hypercardioid | $\begin{bmatrix} 1 & 0.65 & 0.91 & 0.43 & -0.22 \\ 0.65 & 1 & 0.91 & -0.22 & 0.43 \\ 0.91 & 0.91 & 1 & 0.07 & 0.07 \\ 0.43 & -0.22 & 0.07 & 1 & -0.22 \\ -0.22 & 0.43 & 0.07 & -0.22 & 1 \end{bmatrix}$ |

Table 1

| FIG 11 | FIG 11A | FIG 11B | FIG 11C |
|---|---|---|---|

FIG 11A

| Q | $C_y$ |
|---|---|
| $\begin{bmatrix} 1 & 0 \\ 0 & 1 \end{bmatrix}$ | $\begin{bmatrix} 1 & 0 \\ 0 & 1 \end{bmatrix}$ |
| $\begin{bmatrix} 1 & 0 \\ 0 & 1 \end{bmatrix}$ | $\begin{bmatrix} 1 & 0 \\ 0 & 1 \end{bmatrix}$ |
| $\begin{bmatrix} 1 & 0 \\ 0 & 1 \\ 0.71 & 0.71 \\ 1 & 0 \\ 0 & 1 \end{bmatrix}$ | $\begin{bmatrix} 0.5 & 0 & 0 & 0 & 0 \\ 0 & 0.5 & 0 & 0 & 0 \\ 0 & 0 & 2 & 0 & 0 \\ 0 & 0 & 0 & 0.5 & 0 \\ 0 & 0 & 0 & 0 & 0.5 \end{bmatrix}$ |
| $\begin{bmatrix} 1 & 0 & 0 & 0 & 0 \\ 0 & 1 & 0 & 0 & 0 \\ 0 & 0 & 1 & 0 & 0 \\ 0 & 0 & 0 & 0.71 & 0 \\ 0 & 0 & 0 & 0 & 0.71 \\ 0 & 0 & 0 & 0.71 & 0 \\ 0 & 0 & 0 & 0 & 0.71 \end{bmatrix}$ | $\begin{bmatrix} 1 & 0 & 0 & 0 & 0 & 0 & 0 \\ 0 & 1 & 0 & 0 & 0 & 0 & 0 \\ 0 & 0 & 1 & 0 & 0 & 0 & 0 \\ 0 & 0 & 0 & 0.5 & 0 & 0 & 0 \\ 0 & 0 & 0 & 0 & 0.5 & 0 & 0 \\ 0 & 0 & 0 & 0 & 0 & 0.5 & 0 \\ 0 & 0 & 0 & 0 & 0 & 0 & 0.5 \end{bmatrix}$ |
| $\begin{bmatrix} 1 & 0 & 0.71 & 1 & 0 \\ 0 & 1 & 0.71 & 0 & 1 \end{bmatrix}$ | $\begin{bmatrix} 2.5 & 0.5 \\ 0.5 & 2.5 \end{bmatrix}$ |
| $\begin{bmatrix} 1 & 0 & 0 & 0 & 0 \\ 0 & 1 & 0 & 0 & 0 \\ 0 & 0 & 1 & 0 & 0 \\ 0 & 0 & 0 & 1 & 0 \\ 0 & 0 & 0 & 0 & 1 \end{bmatrix}$ | $\begin{bmatrix} 1 & 0 & 0 & 0 & 0 \\ 0 & 1 & 0 & 0 & 0 \\ 0 & 0 & 1 & 0 & 0 \\ 0 & 0 & 0 & 1 & 0 \\ 0 & 0 & 0 & 0 & 1 \end{bmatrix}$ |
| $\begin{bmatrix} 1 & 0 & 0 & 0 & 0 \\ 0 & 1 & 0 & 0 & 0 \\ 0 & 0 & 1 & 0 & 0 \\ 0 & 0 & 0 & 1 & 0 \\ 0 & 0 & 0 & 0 & 1 \end{bmatrix}$ | $\begin{bmatrix} 1 & 0 & 0 & 0 & 0 \\ 0 & 1 & 0 & 0 & 0 \\ 0 & 0 & 1 & 0 & 0 \\ 0 & 0 & 0 & 1 & 0 \\ 0 & 0 & 0 & 0 & 1 \end{bmatrix}$ |

Table 1

| FIG 11 | FIG 11A | FIG 11B | FIG 11C |
|---|---|---|---|

FIG 11B

| M | $C_i$ |
|---|---|
| $\begin{bmatrix} 1.5 & -0.75 \\ -0.75 & 1.5 \end{bmatrix}$ | $\begin{bmatrix} 0 & 0 \\ 0 & 0 \end{bmatrix}$ |
| $\begin{bmatrix} 2.1 & -1.4 \\ -1.4 & 2.1 \end{bmatrix}$ | $\begin{bmatrix} 0.31 & -0.31 \\ -0.31 & 0.31 \end{bmatrix}$ |
| $\begin{bmatrix} 0.33 & -0.17 \\ -0.17 & 0.33 \\ 0.47 & 0.47 \\ 0.33 & -0.17 \\ -0.17 & 0.33 \end{bmatrix}$ | $\begin{bmatrix} 0.33 & 0.08 & -0.24 & -0.17 & 0.08 \\ 0.08 & 0.33 & -0.24 & 0.08 & -0.17 \\ -0.24 & -0.24 & 0.67 & -0.24 & -0.24 \\ -0.17 & 0.08 & -0.24 & 0.33 & 0.08 \\ 0.08 & -0.17 & -0.24 & 0.08 & 0.33 \end{bmatrix}$ |
| $\begin{bmatrix} 1 & 0 & 0 & 0 & 0 \\ 0 & 1 & 0 & 0 & 0 \\ 0 & 0 & 1 & 0 & 0 \\ 0 & 0 & 0 & 0.5 & 0 \\ 0 & 0 & 0 & 0 & 0.5 \\ 0 & 0 & 0 & 0.5 & 0 \\ 0 & 0 & 0 & 0 & 0.5 \end{bmatrix}$ | $\begin{bmatrix} 0 & 0 & 0 & 0 & 0 & 0 & 0 \\ 0 & 0 & 0 & 0 & 0 & 0 & 0 \\ 0 & 0 & 0 & 0 & 0 & 0 & 0 \\ 0 & 0 & 0 & 0.25 & 0 & -0.25 & 0 \\ 0 & 0 & 0 & 0 & 0.25 & 0 & -0.25 \\ 0 & 0 & 0 & -0.25 & 0 & 0.25 & 0 \\ 0 & 0 & 0 & 0 & -0.25 & 0 & 0.25 \end{bmatrix}$ |
| $\begin{bmatrix} 0.84 & 0.02 & 0.61 & 0.84 & 0.02 \\ 0.02 & 0.84 & 0.61 & 0.02 & 0.84 \end{bmatrix}$ | $\begin{bmatrix} 0 & 0 \\ 0 & 0 \end{bmatrix}$ |
| $\begin{bmatrix} 1.7 & -0.53 & -0.05 & -0.05 & -0.53 \\ -0.53 & 1.7 & -0.53 & -0.05 & -0.05 \\ -0.05 & -0.53 & 1.7 & -0.53 & -0.05 \\ -0.05 & -0.05 & -0.53 & 1.7 & -0.53 \\ -0.53 & -0.05 & -0.05 & -0.53 & 1.7 \end{bmatrix}$ | $\begin{bmatrix} 0.4 & -0.32 & 0.12 & 0.12 & -0.32 \\ -0.32 & 0.4 & -0.32 & 0.12 & 0.12 \\ 0.12 & -0.32 & 0.4 & -0.32 & 0.12 \\ 0.12 & 0.12 & -0.32 & 0.4 & -0.32 \\ -0.32 & 0.12 & 0.12 & -0.32 & 0.4 \end{bmatrix}$ |
| $\begin{bmatrix} 2 & -0.51 & -0.83 & -0.53 & 0.41 \\ -0.51 & 2 & -0.83 & -0.41 & -0.53 \\ -0.83 & -0.83 & 2.1 & 0.04 & 0.04 \\ -0.53 & 0.41 & 0.04 & 1.2 & -0.07 \\ 0.41 & -0.53 & 0.04 & -0.07 & 1.2 \end{bmatrix}$ | $\begin{bmatrix} 0.58 & -0.2 & -0.34 & -0.23 & 0.19 \\ -0.2 & 0.58 & -0.34 & 0.19 & -0.23 \\ -0.34 & -0.34 & 0.62 & 0.03 & 0.03 \\ -0.23 & 0.19 & 0.03 & 0.11 & -0.11 \\ 0.19 & -0.23 & 0.03 & -0.11 & 0.11 \end{bmatrix}$ |

Table 1

| FIG 11 | FIG 11A | FIG 11B | FIG 11C |
|---|---|---|---|

FIG 11C

Listing 1: Matlab implementation of the proposed method

```
function [M,Cr]=formulate_M_and_Cr (Cx, Cy, Q, flag)
% flag = 0: Expect usage of residuals
% flag = 1: Fix energies instead
lambda=eye(length(Cy),length(Cx));

% Decomposition of Cy
[U_Cy,S_Cy]=svd(Cy);
Ky=U_Cy*sqrt(S_Cy);

% Decomposition of Cx
[U_Cx,S_Cx]=svd(Cx);
Kx=U_Cx*sqrt(S_Cx);

% SVD of Kx
Ux=U_Cx;
Sx=sqrt(S_Cx);
% Vx = identity matrix

% A simple regularization of the inverse
Sx_diag=diag(Sx);
limit=max(Sx_diag)*0.2;
Sx_hat_diag=max(Sx_diag,limit);

```

| FIG 12 | FIG 12A |
|---|---|
| | FIG 12B |

FIG 12A

```
% Formulate regularized Kx^ -1
Kx_hat_inverse=diag(1./Sx_hat_diag)*Ux';

% Formulate optimal P
[U,S,V]=svd(Kx'*Q'*Ky);
P=V*lambda*U';

% Using which we get opzimal M
M=Ky*P*Kx_hat_inverse;

% Formulate residual covariance matrix
Cy_hat = M*Cx*M';
Cr=Cy-Cy_hat;

% Use energy compensation instead of residuals
if flag==1
    adjustment=diag(Cy)./diag(Cy_hat+1e-20);
    G=diag(sqrt(adjustment));
    M=G*M;
    Cr='unnecessary';
end
```

| FIG 12 | FIG 12A |
|---|---|
| | FIG 12B |

FIG 12B

OPTIMAL MIXING MATRICES AND USAGE OF DECORRELATORS IN SPATIAL AUDIO PROCESSING

CROSS-REFERENCE TO RELATED APPLICATIONS

This application is a continuation of U.S. application Ser. No. 14/180,230 filed Feb. 13, 2014, which is a continuation of International Application No. PCT/EP2012/065861, filed Aug. 14, 2012, which are each incorporated herein in its entirety by this reference thereto, and which claim priority from U.S. Application No. 61/524,647, filed Aug. 17, 2011, and from EP 12156351.4, filed Feb. 21, 2012, which are each incorporated herein in its entirety by this reference thereto.

The present invention relates to audio signal processing and, in particular, to an apparatus and a method employing optimal mixing matrices and, furthermore, to the usage of decorrelators in spatial audio processing.

BACKGROUND OF THE INVENTION

Audio processing becomes more and more important. In perceptual processing of spatial audio, a typical assumption is that the spatial aspect of a loudspeaker-reproduced sound is determined especially by the energies and the time-aligned dependencies between the audio channels in perceptual frequency bands. This is founded on the notion that these characteristics, when reproduced over loudspeakers, transfer into inter-aural level differences, inter-aural time differences and inter-aural coherences, which are the binaural cues of spatial perception. From this concept, various spatial processing methods have emerged, including upmixing, see

[1] C. Faller, "Multiple-Loudspeaker Playback of Stereo Signals", Journal of the Audio Engineering Society, Vol. 54, No. 11, pp. 1051-1064, June 2006, spatial microphony, see, for example,

[2] V. Pulkki, "Spatial Sound Reproduction with Directional Audio Coding", Journal of the Audio Engineering Society, Vol. 55, No. 6, pp. 503-516, June 2007; and

[3] C. Tournery, C. Faller, F. Küch, J. Herre, "Converting Stereo Microphone Signals Directly to MPEG Surround", 128th AES Convention, May 2010;

and efficient stereo and multichannel transmission, see, for example,

[4] J. Breebaart, S. van de Par, A. Kohlrausch and E. Schuijers, "Parametric Coding of Stereo Audio", EURASIP Journal on Applied Signal Processing, Vol. 2005, No. 9, pp. 1305-1322, 2005; and

[5] J. Herre, K. Kjörling, J. Breebaart, C. Faller, S. Disch, H. Purnhagen, J. Koppens, J. Hilpert, J. Rödén, W. Oomen, K. Linzmeier and K. S. Chong, "MPEG Surround—The ISO/MPEG Standard for Efficient and Compatible Multichannel Audio Coding", Journal of the Audio Engineering Society, Vol. 56, No. 11, pp. 932-955, November 2008.

Listening tests have confirmed the benefit of the concept in each application, see, for example, [1, 4, 5] and, for example,

[6] J. Vilkamo, V. Pulkki, "Directional Audio Coding: Virtual Microphone-Based Synthesis and Subjective Evaluation", Journal of the Audio Engineering Society, Vol. 57, No. 9, pp. 709-724, September 2009.

All these technologies, although different in application, have the same core task, which is to generate from a set of input channels a set of output channels with defined energies and dependencies as function of time and frequency, which may be assumed to be the common underlying task in perceptual spatial audio processing. For example, in the context of Directional Audio Coding (DirAC) see, for example, [2], the source channels are typically first order microphone signals, which are by means of mixing, amplitude panning and decorrelation processed to perceptually approximate a measured sound field. In upmixing (see [1]), the stereo input channels are, again, as function of time and frequency, distributed adaptively to a surround setup.

SUMMARY

According to an embodiment, an apparatus for generating an audio output signal having two or more audio output channels from an audio input signal having two or more audio input channels may have: a provider for providing first covariance properties of the audio input signal, and a signal processor for generating the audio output signal by applying a mixing rule on at least two of the two or more audio input channels, wherein the signal processor is configured to determine the mixing rule based on the first covariance properties of the audio input signal and based on second covariance properties of the audio output signal, the second covariance properties being different from the first covariance properties.

According to another embodiment, a method for generating an audio output signal having two or more audio output channels from an audio input signal having two or more audio input channels may have the steps of: providing first covariance properties of the audio input signal, and generating the audio output signal by applying a mixing rule on at least two of the two or more audio input channels, wherein the mixing rule is determined based on the first covariance properties of the audio input signal and based on second covariance properties of the audio output signal being different from the first covariance properties.

Another embodiment may have a computer program for implementing the method of claim 25 when being executed on a computer or processor.

An apparatus for generating an audio output signal having two or more audio output channels from an audio input signal having two or more audio input channels is provided. The apparatus comprises a provider and a signal processor. The provider is adapted to provide first covariance properties of the audio input signal. The signal processor is adapted to generate the audio output signal by applying a mixing rule on at least two of the two or more audio input channels. The signal processor is configured to determine the mixing rule based on the first covariance properties of the audio input signal and based on second covariance properties of the audio output signal, the second covariance properties being different from the first covariance properties.

For example, the channel energies and the time-aligned dependencies may be expressed by the real part of a signal covariance matrix, for example, in perceptual frequency bands. In the following, a generally applicable concept to process spatial sound in this domain is presented. The concept comprises an adaptive mixing solution to reach given target covariance properties (the second covariance properties), e.g., a given target covariance matrix, by best usage of the independent components in the input channels. In an embodiment, means may be provided to inject the amount of decorrelated sound energy needed, when the target is not achieved otherwise. Such a concept is robust in its function and may be applied in numerous use cases. The target covariance properties may, for example, be provided by a user. For example, an apparatus according to an embodiment may have means such that a user can input the covariance properties.

According to an embodiment, the provider may be adapted to provide the first covariance properties, wherein the first covariance properties have a first state for a first time-frequency bin, and wherein the first covariance properties have a second state, being different from the first state, for a second time-frequency bin, being different from the first time-frequency bin. The provider does not necessarily need to perform the analysis for obtaining the covariance properties, but can provide this data from a storage, a user input or from similar sources.

In another embodiment, the signal processor may be adapted to determine the mixing rule based on the second covariance properties, wherein the second covariance properties have a third state for a third time-frequency bin, and wherein the second covariance properties have a fourth state, being different from the third state for a fourth time-frequency bin, being different from the third time-frequency bin.

According to another embodiment, the signal processor is adapted to generate the audio output signal by applying the mixing rule such that each one of the two or more audio output channels depends on each one of the two or more audio input channels.

In another embodiment, the signal processor may be adapted to determine the mixing rule such that an error measure is minimized. An error measure may, for example, be an absolute difference signal between a reference output signal and an actual output signal.

In an embodiment, an error measure may, for example, be a measure depending on $$\|y_{ref}-y\|^2$$

wherein y is the audio output signal, wherein $$y_{ref}=Qx,$$

wherein x specifies the audio input signal and wherein Q is a mapping matrix, that may be application-specific, such that $y_{ref}$ specifies a reference target audio output signal.

According to a further embodiment, the signal processor may be adapted to determine the mixing rule such that $$e=E[\|y_{ref}-y\|^2]$$

is minimized, wherein E is an expectation operator, wherein $y_{ref}$ is a defined reference point, and wherein y is the audio output signal.

According to a further embodiment, the signal processor may be configured to determine the mixing rule by determining the second covariance properties, wherein the signal processor may be configured to determine the second covariance properties based on the first covariance properties.

According to a further embodiment, the signal processor may be adapted to determine a mixing matrix as the mixing rule, wherein the signal processor may be adapted to determine the mixing matrix based on the first covariance properties and based on the second covariance properties.

In another embodiment, the provider may be adapted to analyze the first covariance properties by determining a first covariance matrix of the audio input signal and wherein the signal processor may be configured to determine the mixing rule based on a second covariance matrix of the audio output signal as the second covariance properties.

According to another embodiment, the provider may be adapted to determine the first covariance matrix such that each diagonal value of the first covariance matrix may indicate an energy of one of the audio input channels and such that each value of the first covariance matrix which is not a diagonal value may indicate an inter-channel correlation between a first audio input channel and a different second audio input channel.

According to a further embodiment, the signal processor may be configured to determine the mixing rule based on the second covariance matrix, wherein each diagonal value of the second covariance matrix may indicate an energy of one of the audio output channels and wherein each value of the second covariance matrix which is not a diagonal value may indicate an inter-channel correlation between a first audio output channel and a second audio output channel.

According to another embodiment, the signal processor may be adapted to determine the mixing matrix such that:

$$M=K_yPK_x^{-1}$$

such that $$K_xK_x^T=C_x$$

$$K_yK_y^T=C_y$$

wherein M is the mixing matrix, wherein $C_x$ is the first covariance matrix, wherein $C_y$ is the second covariance matrix, wherein $K_x^T$ is a first transposed matrix of a first decomposed matrix $K_x$, wherein $K_y^T$ is a second transposed matrix of a second decomposed matrix $K_y$, wherein $K_x^{-1}$ is an inverse matrix of the first decomposed matrix $K_x$ and wherein P is a first unitary matrix.

In a further embodiment, the signal processor may be adapted to determine the mixing matrix such that $$M=K_yPK_x^{-1}$$

wherein $$P=VU^T$$

wherein $U^T$ is a third transposed matrix of a second unitary matrix U, wherein V is a third unitary matrix, wherein $$USV^T=K_x^TQ^TK_y$$

wherein $Q^T$ is a fourth transposed matrix of the downmix matrix Q, wherein $V^T$ is a fifth transposed matrix of the third unitary matrix V, and wherein S is a diagonal matrix.

According to another embodiment, the signal processor is adapted to determine a mixing matrix as the mixing rule, wherein the signal processor is adapted to determine the mixing matrix based on the first covariance properties and based on the second covariance properties, wherein the provider is adapted to provide or analyze the first covariance properties by determining a first covariance matrix of the audio input signal, and wherein the signal processor is configured to determine the mixing rule based on a second covariance matrix of the audio output signal as the second covariance properties, wherein the signal processor is configured to modify at least some diagonal values of a diagonal matrix $S_x$ when the values of the diagonal matrix $S_x$ are zero or smaller than a predetermined threshold value, such that the values are greater than or equal to the threshold value, wherein the signal processor is adapted to determine the mixing matrix based on the diagonal matrix. However, the threshold value need not necessarily be predetermined but can also depend on a function.

In a further embodiment, the signal processor is configured to modify the at least some diagonal values of the diagonal matrix $S_x$, wherein $K_x=U_xS_xV_x^T$, and wherein $C_x=K_xK_x^T$, wherein $C_x$ is the first covariance matrix, wherein $S_x$ is the diagonal matrix, wherein $U_x$ is a second matrix, $V_x^T$ is a third transposed matrix, and wherein $K_x^T$ is a fourth transposed matrix of the fifth matrix $K_x$. The matrices $V_x$ and $U_x$ can be unitary matrices.

According to another embodiment, the signal processor is adapted to generate the audio output signal by applying the mixing rule on at least two of the two or more audio input channels to obtain an intermediate signal $y'=\hat{M}x$ and by adding a residual signal r to the intermediate signal to obtain the audio output signal.

In another embodiment, the signal processor is adapted to determine the mixing matrix based on a diagonal gain matrix G and an intermediate matrix $\hat{M}$, such that $M'=G\hat{M}$, wherein the diagonal gain matrix has the value $$G(i, i) = \sqrt{\frac{C_y(i, i)}{\hat{C}_y(i, i)}}$$

where $\hat{C}_y=\hat{M}C_x\hat{M}^T$, wherein M' is the mixing matrix, wherein G is the diagonal gain matrix and wherein $\hat{M}$ is the intermediate matrix, wherein $C_y$ is the second covariance matrix and wherein $\hat{M}^T$ is a fifth transposed matrix of the matrix $\hat{M}$.

BRIEF DESCRIPTION OF THE DRAWINGS

Embodiments of the present invention will be detailed subsequently referring to the appended drawings, in which:

FIGS. 11A to 11C illustrate table 1 showing numerical examples of an embodiment, and FIGS. 12A and 12B depict listing 1 which shows a Matlab implementation of a method according to an embodiment.

DETAILED DESCRIPTION OF THE INVENTION

Figure 1:
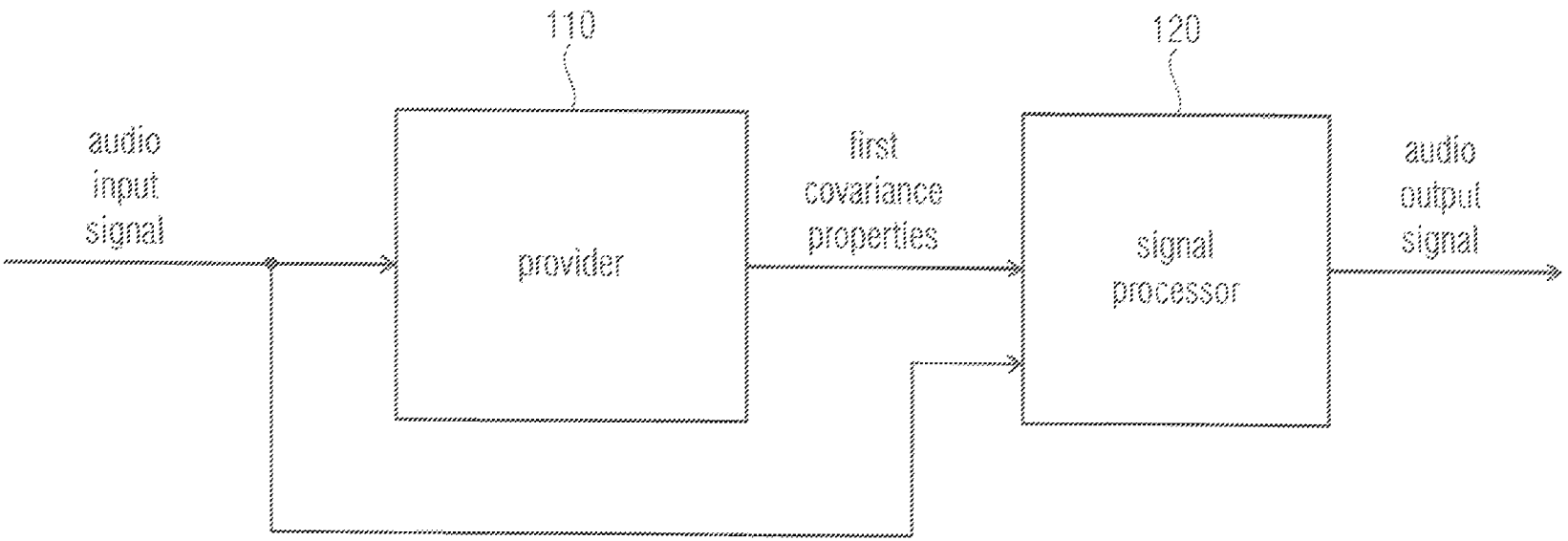
FIG. 1 illustrates an apparatus for generating an audio output signal having two or more audio output channels from an audio input signal having two or more audio input channels according to an embodiment.

FIG. 1 illustrates an apparatus for generating an audio output signal having two or more audio output channels from an audio input signal having two or more audio input channels according to an embodiment. The apparatus comprises a provider 110 and a signal processor 120. The provider 110 is adapted to receive the audio input signal having two or more audio input channels. Moreover, the provider 110 is a adapted to analyze first covariance properties of the audio input signal. The provider 110 is furthermore adapted to provide the first covariance properties to the signal processor 120. The signal processor 120 is furthermore adapted to receive the audio input signal. The signal processor 120 is moreover adapted to generate the audio output signal by applying a mixing rule on at least two of the two or more input channels of the audio input signal. The signal processor 120 is configured to determine the mixing rule based on the first covariance properties of the audio input signal and based on second covariance properties of the audio output signal, the second covariance properties being different from the first covariance properties.

Figure 2:
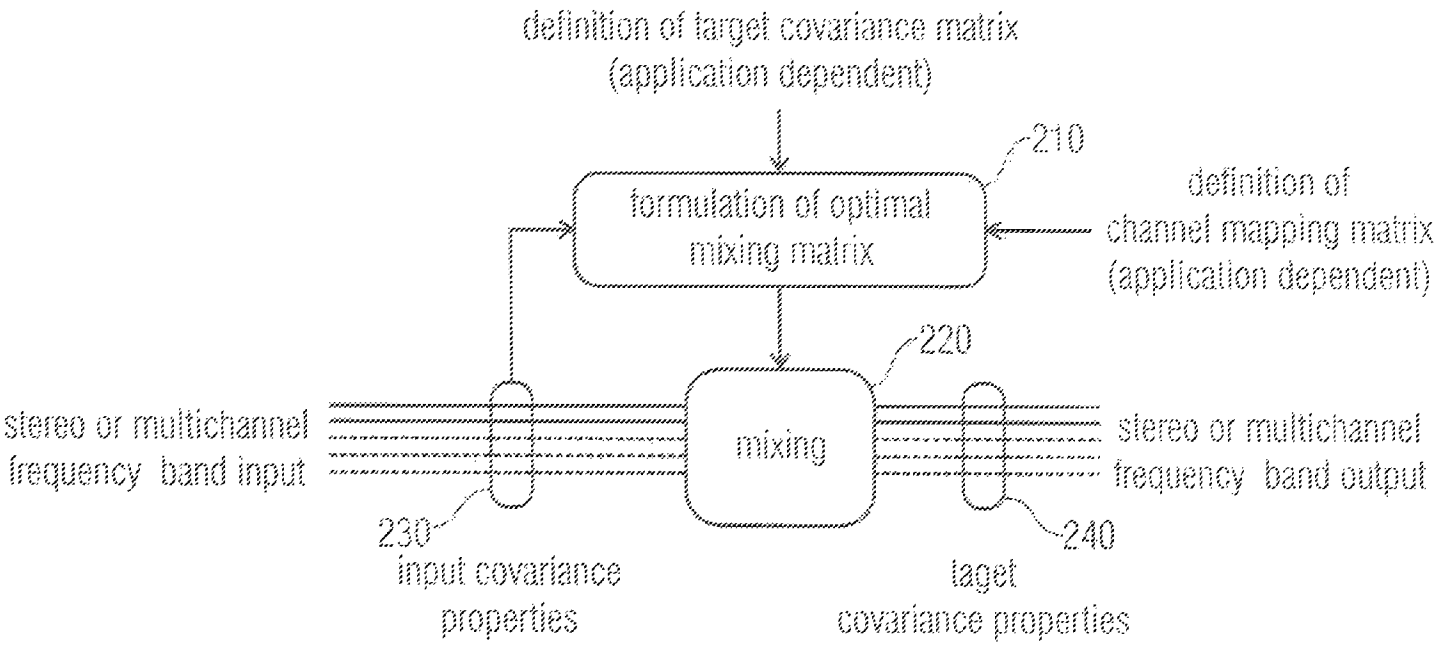
FIG. 2 depicts a signal processor according to an embodiment.

FIG. 2 illustrates a signal processor according to an embodiment. The signal processor comprises an optimal mixing matrix formulation unit 210 and a mixing unit 220. The optimal mixing matrix formulation unit 210 formulates an optimal mixing matrix. For this, the optimal mixing matrix formulation unit 210 uses the first covariance properties 230 (e.g. input covariance properties) of a stereo or multichannel frequency band audio input signal as received, for example, by a provider 110 of the embodiment of FIG. 1. Moreover, the optimal mixing matrix formulation unit 210 determines the mixing matrix based on second covariance properties 240, e.g., a target covariance matrix, which may be application dependent. The optimal mixing matrix that is formulated by the optimal mixing matrix formulation unit 210 may be used as a channel mapping matrix. The optimal mixing matrix may then be provided to the mixing unit 220. The mixing unit 220 applies the optimal mixing matrix on the stereo or multichannel frequency band input to obtain a stereo or multichannel frequency band output of the audio output signal. The audio output signal has the desired second covariance properties (target covariance properties).

To explain embodiments of the present invention in more detail, definitions are introduced. Now, the zero-mean complex input and output signals $x_i(t,f)$ and $y_j(t,f)$ are defined, wherein t is the time index, wherein f is the frequency index, wherein i is the input channel index, and wherein j is the output channel index. Furthermore, the signal vectors of the audio input signal x and the audio output signal y are defined:

$$x_{N_x}(t, f) = \begin{bmatrix} x_1(t, f) \\ x_2(t, f) \\ \vdots \\ x_{N_x}(t, f) \end{bmatrix} \quad (1)$$

$$y_{N_y}(t, f) = \begin{bmatrix} y_1(t, f) \\ y_2(t, f) \\ \vdots \\ y_{N_y}(t, f) \end{bmatrix}$$

where $N_x$ and $N_y$ are the total number of input and output channels. Moreover, $N=\max(N_y, N_x)$ and equal dimension 0-padded signals are defined:

$$x(t, f) = \begin{bmatrix} x_{N_x}(t, f) \\ 0_{(N-N_x)\times 1} \end{bmatrix} \quad (2)$$

-continued $$y(t, f) = \begin{bmatrix} y_{N_y}(t, f) \\ 0_{(N-N_y)\times 1} \end{bmatrix}.$$

The zero-padded signals may be used in the formulation until when the derived solution is extended to different vector lengths.

As has been explained above, the widely used measure for describing the spatial aspect of a multichannel sound is the combination of the channel energies and the time-aligned dependencies. These properties are comprised in the real part of the covariance matrices, defined as:

$$C_x = E[Re\{xx^H\}]$$

$$C_y = E[Re\{yy^H\}] \tag{3}$$

In equation (3) and in the following, E[ ] is the expectation operator, Re{ } is the real part operator, and $x^H$ and $y^H$ are the conjugate transposes of x and y. The expectation operator E[ ] is a mathematic operator. In practical applications it is replaced by an estimation such as an average over a certain time interval. In the following sections, the usage of the term covariance matrix refers to this real-valued definition. $C_x$ and $C_y$ are symmetric and positive semi-definite and, thus, real matrices $K_x$ and $K_y$ can be defined, so that:

$$C_x = K_x K_x^T$$

$$C_x = K_y K_y^T. \tag{4}$$

Such decompositions can be obtained for example by using Cholesky decomposition or eigendecomposition, see, for example,

[7] Golub, G. H. and Van Loan, C. F., "Matrix computations", Johns Hopkins Univ Press, 1996.

It should be noted, that there is an infinite number of decompositions fulfilling equation (4). For any orthogonal matrices $P_x$ and $P_y$, matrices $K_xP_x$ and $K_yP_y$ also fulfill the condition since $$K_xP_xP_x^TK_x^T = K_xK_x^T = C_x$$

$$K_yP_yP_y^TK_y^T = K_yK_y^T = C_y. \tag{5}$$

in stereo used cases, the covariance matrix is often given in form of the channel energies and the inter-channel correlation (ICC), e.g., in [1, 3, 4]. The diagonal values of $C_x$ are the channel energies and the ICC between the two channels is $$ICC_x = \frac{C_x(1, 2)}{\sqrt{C_x(1, 1)C_x(2, 2)}} \tag{6}$$

and correspondingly for $C_y$. The indices in the brackets denote matrix row and column.

The remaining definition is the application-determined mapping matrix Q, which comprises the information, which input channels are to be used in composition of each output channel. With Q one may define a reference signal $$y_{ref} = Qx. \tag{7}$$

The mapping matrix Q can comprises changes in the dimensionality, and scaling, combination and re-ordering of the channels. Due to the zero-padded definition of the signals, Q is here an N×N square matrix that may comprise zero rows or columns. Some examples of Q are:

Spatial enhancement: Q=I, in applications, where the output should best resemble the input.

Downmixing: Q is a downmixing matrix.

Spatial synthesis from first-order microphone signals: Q may be, for example, an Ambisonic microphone mixing matrix, which means that $y_{ref}$ is a set of virtual microphone signals.

In the following, it is formulated how to generate a signal y from a signal x, with a constraint that y has the application-defined covariance matrix $C_y$. The application also defines a mapping matrix Q that gives a reference point for the optimization. The input signal x has the measured covariance matrix $C_x$. As stated, the proposed concepts to perform this transform are using primarily a concept of only optimal mixing of the channels, since using decorrelators typically comprises the signal quality, and secondarily, by injection of decorrelated energy when the goal is not otherwise achieved.

The input-output relation according to these concepts can be written as $$y = Mx + r \tag{8}$$

where M is a real mixing matrix according to the primary concept and r is a residual signal according to the secondary concept.

In the following, concepts are proposed for covariance matrix modification.

First, the task according to the primary concept is solved by only cross-mixing the input channels. Equation (8) then simplifies to $$y = Mx. \tag{9}$$

From equations (3) and (9), one has $$\begin{aligned} C_y &= E[Re\{yy^H\}] \\ &= E[Re\{Mxx^H M^H\}] \\ &= MC_xM^T. \end{aligned} \tag{10}$$

From equations (5) and (10) it follows that $$K_yP_yP_y^TK_y^T = MK_xP_xP_x^TK_x^TM^T \tag{11}$$

from which a set of solutions for M that fulfill equation (10) follows $$M = K_yP_yP_x^TK_x^{-1} = K_yPK_x^{-1} \tag{12}$$

The condition for these solutions is that $K_x^{-1}$ exists. The orthogonal matrix $P = P_yP_x^T$ is the remaining free parameter.

In the following, it is described how a matrix P is found that provides an optimal matrix M. From all M in equation (12), it is searched for one that produces an output closest to the defined reference point $y_{ref}$, i.e., that minimizes $$e = E[\|y_{ref} - y\|^2] \tag{13a}$$

i.e., that minimizes $$e = E[\|y_{ref} - y\|^2] - E[\|Qx - Mx\|^2]. \tag{13}$$

Now, a signal w is defined, such that $E[Re\{ww^H\}] = I$. w can be chosen such that $x = K_xw$, since $$\begin{aligned} E[Re\{xx^H\}] &= E[Re\{K_x ww^H K_x^T\}] \\ &= K_x E[Re\{ww^H\}] K_x^T \\ &= K_x K_x^T \\ &= C_x. \end{aligned} \tag{14}$$

It then follows that $$Mx=MK_x w=K_y Pw. \tag{15}$$

Equation (13) can be written as $$\begin{aligned} e &= E[\|Qx-\mathrm{Mx}\|^2] \\ &= E[\|QK_x w-K_y Pw\|^2] \\ &= E[\|(QK_x-K_y P)w\|^2] \\ &= E\left[w^H(QK_x-K_y P)^T(QK_x-K_y P)w\right]. \end{aligned} \tag{16}$$

From $E[\mathrm{Re}\{ww^H\}]=I$, it can be readily shown for a real symmetric matrix A that $E[w^H Aw]=\mathrm{tr}(A)$, which is the matrix trace. It follows that equation (16) takes the form $$e=tr[(QK_x-K_y P)^T(QK_x-K_y P)]. \tag{17}$$

For matrix traces, it can be readily confirmed that $$tr(A-B)=tr(A)+tr(B)$$

$$tr(A)=tr(A^T)$$

$$tr(P^T AP)=tr(A). \tag{18}$$

Using these properties, equation (17) takes the form $$e=tr(K_x^T Q^T QK_x)+tr(K_y^T K_y)-2tr(K_x^T Q^T K_y P). \tag{19}$$

Only the last term depends on P. The optimization problem is thus $$P=\arg\min_P e=\arg\max_P[tr(K_x^T Q^T K_y P)]. \tag{20}$$

It can be readily shown for a non-negative diagonal matrix S and any orthogonal matrix $P_s$ that $$tr(S)\geq tr(SP_S). \tag{21}$$

Thereby, by defining the singular value decomposition $USV^T=K_x^T Q^T K_y$, where S is non-negative and diagonal and U and V are orthogonal, it follows that $$\begin{aligned} tr(S) \geq tr(SV^T PU) &= tr(USV^T PUU^T) \\ &= tr(K_x^T Q^T K_y P) \end{aligned} \tag{22}$$

for any orthogonal P. The equality holds for $$P=VU^T \tag{21}$$

whereby this P yields the maximum of $\mathrm{tr}(K_x^T Q^T K_y P)$ and the minimum of the error measure in equation (13).

An apparatus according to an embodiment determines an optimal mixing matrix M, such that an error e is minimized. It should be noted that the covariance properties of the audio input signal and the audio output signal may vary for different time-frequency bins. For that, a provider of an apparatus according to an embodiment is adapted to analyze the covariance properties of the audio input channel which may be different for different time-frequency bins. Moreover, the signal processor of an apparatus according to an embodiment is adapted to determine a mixing rule, e.g., a mixing matrix M based on second covariance properties of the audio output signal, wherein the second covariance properties may have different values for different time-frequency bins.

As the determined mixing matrix M is applied on each of the audio input channels of the audio input signal, and as each of the resulting audio output channels of the audio output signal may thus depend on each one of the audio input channels, a signal processor of an apparatus according to an embodiment is therefore adapted to generate the audio output signal by applying the mixing rule such that each one of the two or more audio output channels depends on each one of the two or more audio input channels of the audio input signal.

According to another embodiment, it is proposed to use the decorrelation when $K_x^{-1}$ does not exist or is unstable. In the embodiments described above, a solution was provided for determining an optimal mixing matrix where it was assumed that $K_x^{-1}$ exists. However, $K_x^{-1}$ may not always exist or its inverse may entail very large multipliers if some of the principle components in x are very small. An effective way to regularize the inverse is to employ the singular value decomposition $K_x=U_x S_x V_x^T$. Accordingly, the inverse is $$K_x^{-1}=V_x S_x^{-1} U_x^T. \tag{24}$$

Problems arise when some of the diagonal values of the non-negative diagonal matrix $S_x$ are zero or very small. A concept which robustly regularizes the inverse is then to replace these values with larger values. The result of this procedure is $\hat{S}_x$, and the corresponding inverse $\hat{K}_x^{-1}=V_x\hat{S}_x^{-1}U_x^T$, and the corresponding mixing matrix $\hat{M}=K_y P\hat{K}_x^{-1}$.

This regularization effectively means that within the mixing process, the amplification of some of the small principal components in x is reduced, and consequently their intact to the output signal y is also reduced and the target covariance $C_y$ is in general not reached.

By this, according to an embodiment, the signal processor may be configured to modify at least some diagonal values of a diagonal matrix $S_x$, wherein the values of the diagonal matrix $S_x$ are zero or smaller than a threshold value (the threshold value can be predetermined or can depend on a function), such that the values are greater than or equal to the threshold value, wherein the signal processor may be adapted to determine the mixing matrix based on the diagonal matrix.

According to an embodiment, the signal processor may be configured to modify the at least some diagonal values of the diagonal matrix $S_x$, wherein $K_x=U_x S_x V_x^T$, and wherein $C_x=K_x K_x^T$ wherein $C_x$ is the first covariance matrix, wherein $S_x$ is the diagonal matrix, wherein $U_x$ is a second matrix, $V_x^T$ is a third transpose matrix and wherein $K_x^T$ is a fourth transposed matrix of the fifth matrix $K_x$.

The above loss of a signal component can be fully compensated with a residual signal r. The original input-output relation will be elaborated with the regularized inverse.

$$\begin{aligned} y &= \hat{M}x+r \\ &= K_y P\hat{K}_x^{-1}x+r \\ &= K_y PV_x\hat{S}_x^{-1}U_x^T x+r \end{aligned} \tag{25}$$

Now, an additive component c is defined such that instead of $\hat{S}_x^{-1}U_x^T x$, one has $\hat{S}_x^{-1}$. In addition, an independent signal w' is defined, such that $E[\mathrm{Re}\{w'w'^H\}]=I$ and $$c=\sqrt{I-(\hat{S}_x^{-1}S_x)^2}\,w'. \tag{26}$$

It can be readily shown that a signal $$y' = K_y P V_x (\hat{S}_x^{-1} U_x^T x + c) = \hat{M} x + K_y P V_x c$$

has covariance $C_y$. The residual signal for compensating for the regularization is then $$r = K_y P V_x c. \tag{28}$$

From equations (27) and (28), it follows that $$C_r = E[Re\{rr^H\}] = C_y - \hat{M} C_x \hat{M}^T. \tag{29}$$

As c has been defined as a stochastic signal, it follows that the relevant property of r is its covariance matrix. Thus, any signal that is independent in respect to x that is processed to have the covariance $C_r$ serves as a residual signal that ideally reconstructs the target covariance matrix $C_y$ in situations when the regularization as described was used. Such a residual signal can be readily generated using decorrelators and the proposed method of channel mixing.

Finding analytically the optimal balance between the amount of decorrelated energy and the amplification of small signal components is not straightforward. This is because it depends on application-specific factors such as the stability of the statistical properties of the input signal, applied analysis window and the SNR of the input signal. However, it is rather straightforward to adjust a heuristic function to perform this balancing without obvious disadvantages, as it was done in the example code provided below.

According to this, the signal processor of an apparatus according to an embodiment may be adapted to generate the audio output signal by applying the mixing rule on the at least two of the two or more audio input signals, to obtain an intermediate signal $y' = \hat{M}x$ and by adding a residual signal r to the intermediate signal to obtain the audio output signal.

It has been shown that when the regularization of the inverse of $K_x$ is applied, the missing signal components in the overall output can be fully complemented with a residual signal r with covariance $C_r$. By these means, it can be guaranteed that the target covariance $C_y$ is reached. In the following, one way of generate a corresponding residual signal r is presented. It comprises the following steps:

1. Generate a set of signals as many as output channels. The signal $y_{ref} = Qx$ can be employed, because it has as many channels as the output signal, and each of the output signal contains a signal appropriate for that particular channel.

2. Decorrelate this signal. There are many ways to decorrelate, including all-pass filters, convolutions with noise bursts, and pseudo-random delays in frequency bands.

3. Measure (or assume) the covariance matrix of the decorrelated signal. Measuring is simplest and most robust, but since the signals are from decorrelators, they could be assumed incoherent. Then, only the measurement of energy would be enough.

4. Apply the proposed method to generate a mixing matrix that, when applied to the decorrelated signal, generates an output signal with the covariance matrix $C_r$. Use here a mapping matrix Q=I, because one wishes to minimally affect the signal content.

5. Process the signal from the decorrelators with this mixing matrix and feed it to the output signal to complement for the lack of the signal components. By this, the target $C_y$ is reached.

In an alternative embodiment decorrelated channels are appended to the (at least one) input signal prior to formulating the optimal mixing matrix. In this case, the input and the output is of same dimension, and provided that the input signal has as many independent signal components as there are input channels, there is no need to utilize a residual signal r. When the decorrelators are used this way, the use of decorrelators is "invisible" to the proposed concept, because the decorrelated channels are input channels like any other.

If the usage of decorrelators is undesirable, at least the target channel energies can be achieved by multiplying the rows of the $\hat{M}$ so that $$M' = G\hat{M} \tag{30}$$

where G is a diagonal gain matrix with values $$G(i, i) = \sqrt{\frac{C_y(i, i)}{\hat{C}_y(i, i)}} \tag{31}$$

where $\hat{C}_y = \hat{M} C_x \hat{M}^T$.

In many applications the number of input and output channels is different. As described in Equation (2), zero-padding of the signal with a smaller dimension is applied to have the same dimension as the higher. Zero-padding implies computational overhead because some rows or columns in the resulting M correspond to channels with defined zero energy. Mathematically, equivalent to using first zero-padding and finally cropping M to the relevant dimension $N_y \times N_x$, the overhead can be reduced by introducing matrix $\Lambda$ that is an identity matrix appended with zeros to dimension $N_y \times N_x$, e.g., $$\Lambda_{3\times 2} = \begin{bmatrix} 1 & 0 \\ 0 & 1 \\ 0 & 0 \end{bmatrix}. \tag{32}$$

When P is re-defined so that $$P = V \Lambda U^T \tag{33}$$

the resulting M is a $N_y \times N_x$ mixing matrix that is the same as the relevant part of the M of the zero-padding case. Consequently, $C_x$, $C_y$, $K_x$ and $K_y$ can be their natural dimension and the mapping matrix Q is of dimension $N_y \times N_x$.

The input covariance matrix is decomposable to $C_x = K_x K_x^T$ because it is a positive semi-definite measure from an actual signal. It is however possible to define such target covariance matrices that are not decomposable for the reason that they represent impossible channel dependencies. There are concepts to ensure decomposability, such as adjusting the negative eigenvalues to zeros and normalizing the energy, see, for example,

[8] R. Rebonato, P. Jäckel, "The most general methodology to create a valid correlation matrix for risk management and option pricing purposes", Journal of Risk, Vol. 2, No. 2, pp. 17-28, 2000.

However, the most meaningful usage of the proposed concept is to request only possible covariance matrices.

To summarize the above, the common task can be rephrased as follows. Firstly, one has an input signal with a certain covariance matrix. Secondly, the application defines two parameters: the target covariance matrix and a rule, which input channels are to be used in composition of each output channel. For performing this transform, it is proposed to use the following concepts: The primary concept, as illustrated by FIG. 2, is that the target covariance is achieved with using a solution of optimal mixing of the input channels. This concept is considered primary because it avoids the usage of the decorrelator, which often compromise the signal quality. The secondary concept takes place when there are not enough independent components of reasonable energy available. The decorrelated energy is injected to compensate for the lack of these components. Together, these two concepts provide means to perform robust covariance matrix adjustment in any given scenario.

The main expected application of the proposed concept is in the field of spatial microphony [2,3], which is the field where the problems related to signal covariance are particularly apparent due to physical limitations of directional microphones. Further expected use cases include stereo- and multichannel enhancement, ambiance extraction, upmixing and downmixing.

In the above description, definitions have been given, followed by the derivation of the proposed concept. At first, the cross mixing solution has been provided, then the concept of injecting the correlated sound energy has been given. Afterwards, a description of the concept with a different number of input and output channels has been provided and also considerations on covariance matrix decomposability. In the following, practical use cases are provided and a set of numerical examples and the conclusion are presented. Furthermore, an example Matlab code with complete functionality according to this paper is provided.

The perceived spatial characteristic of a stereo or multichannel sound is largely defined by the covariance matrix of the signal in frequency bands. A concept has been provided to optimally and adaptively crossmix a set of input channels with given covariance properties to a set of output channels with arbitrarily definable covariance properties. A further concept has been provided to inject decorrelated energy only where needed when independent sound components of reasonable energy are not available. The concept has a wide variety of applications in the field of spatial audio signal processing.

The channel energies and the dependencies between the channels (or the covariance matrix) of a multichannel signal can be controlled by only linearly and time-variantly crossmixing the channels depending on the input characteristics and the desired target characteristics. This concept can be illustrated with a factor representation of the signal where the angle between vectors corresponds to channel dependency and the amplitude of the vector equals to the signal level.

Figure 3:
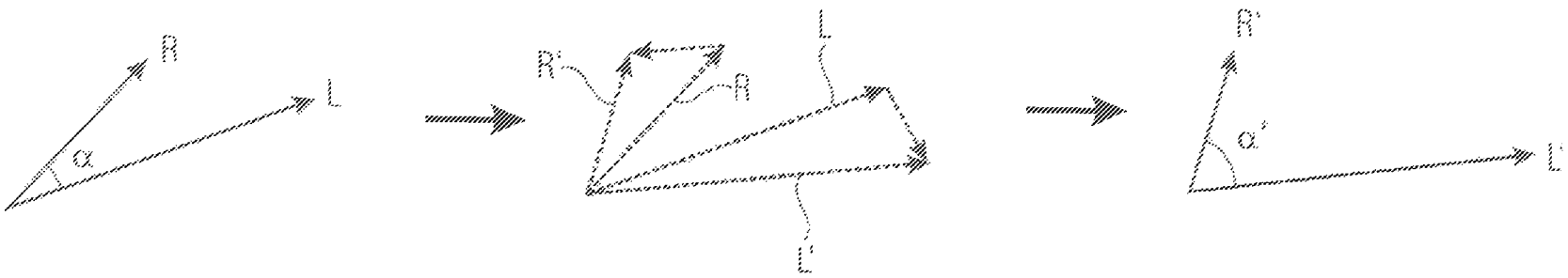
FIG. 3 shows an example for applying a linear combination of vectors L and R to achieve a new vector set R' and L'.

FIG. 3 illustrates an example for applying a linear combination of vectors L and R to achieve a new vector set R' and L'. Similarly, audio channel levels and their dependency can be modified with linear combination. The general solution does not include vectors but a matrix formulation which is optimal for any number of channels.

The mixing matrix for stereo signals can be readily formulated also trigonometrically, as can be seen in FIG. 3. The results are the same as with matrix mathematics, but the formulation is different.

If the input channels are highly dependent, achieving the target covariance matrix is possible only with using decorrelators. A procedure to inject decorrelators only where useful, e.g., optimally, has also been provided.

Figure 4:
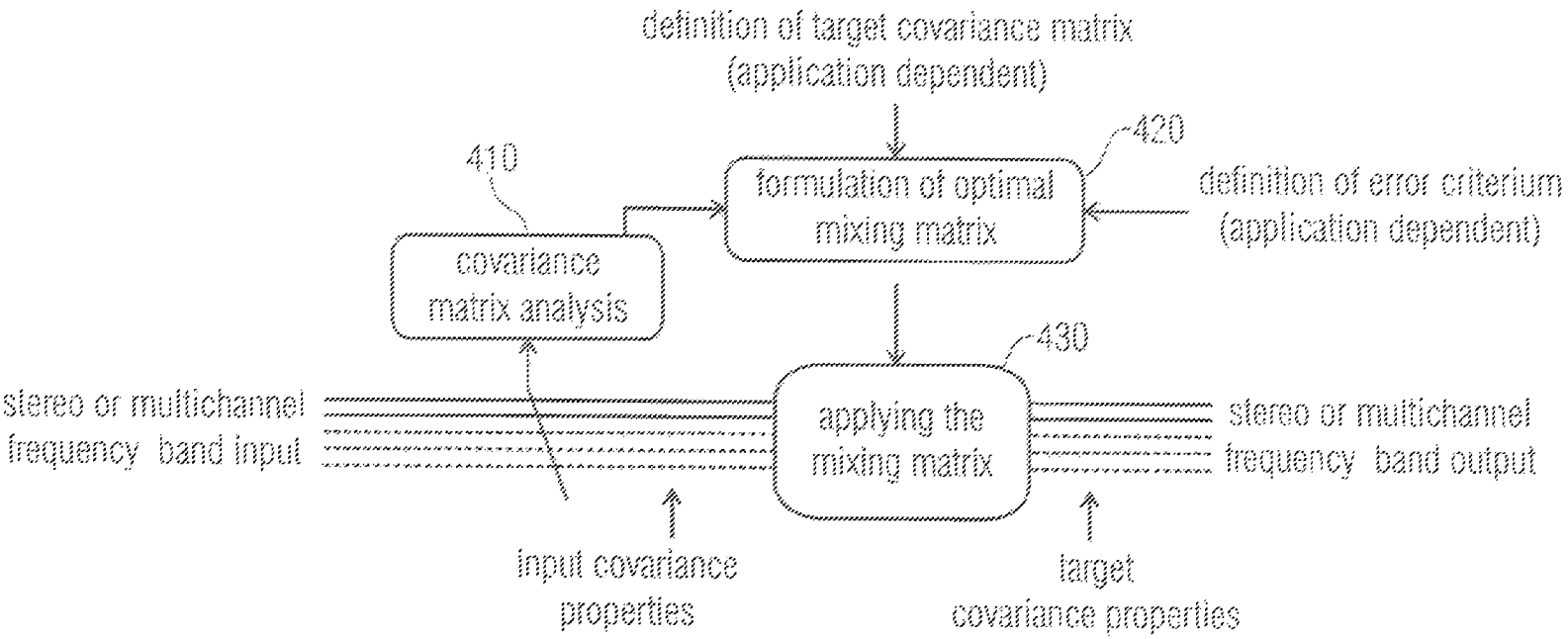
FIG. 4 illustrates a block diagram of an apparatus according to another embodiment.

FIG. 4 illustrates a block diagram of an apparatus of an embodiment applying the mixing technique. The apparatus comprises a covariance matrix analysis module 410, and a signal processor (not shown), wherein the signal processor comprises a mixing matrix formulation module 420 and a mixing matrix application module 430. Input covariance properties of a stereo or multichannel frequency band input are analyzed by a covariance matrix analysis module 410. The result of the covariance matrix analysis is fed into an mixing matrix formulation module 420.

The mixing matrix formulation module 420 formulates a mixing matrix based on the result of the covariance matrix analysis, based on a target covariance matrix and possibly also based on an error criterion.

The mixing matrix formulation module 420 feeds the mixing matrix into a mixing matrix application module 430. The mixing matrix application module 430 applies the mixing matrix on the stereo or multichannel frequency band input to obtain a stereo or multichannel frequency band output having, e.g. predefined, target covariance properties depending on the target covariance matrix.

Summarizing the above, the general purpose of the concept is to enhance, fix and/or synthesize spatial sound with an extreme degree of optimality in terms of sound quality. The target, e.g., the second covariance properties, is defined by the application.

Also applicable in full band, the concept is perceptually meaningful especially in frequency band processing.

Decorrelators are used in order to improve (reduce) the inter-channel correlation. They do this but are prone to compromise the overall sound quality, especially with a transient sound component.

The proposed concept avoids, or in some application minimizes, the usage of decorrelators. The result is the same spatial characteristic but without such loss of sound quality.

Among other uses, the technology may be employed in a SAM-to-MPS encoder.

The proposed concept has been implemented to improve a microphone technique that generates MPEG Surround bit stream (MPEG=Moving Picture Experts Group) out of a signal from first order stereo coincident microphones, see, for example, [3]. The process includes estimating from the stereo signal the direction and the diffuseness of the sound field in frequency bands and creating such an MPEG Surround bit stream that, when decoded in the receiver end, produces a sound field that perceptually approximates the original sound field.

Figure 5:
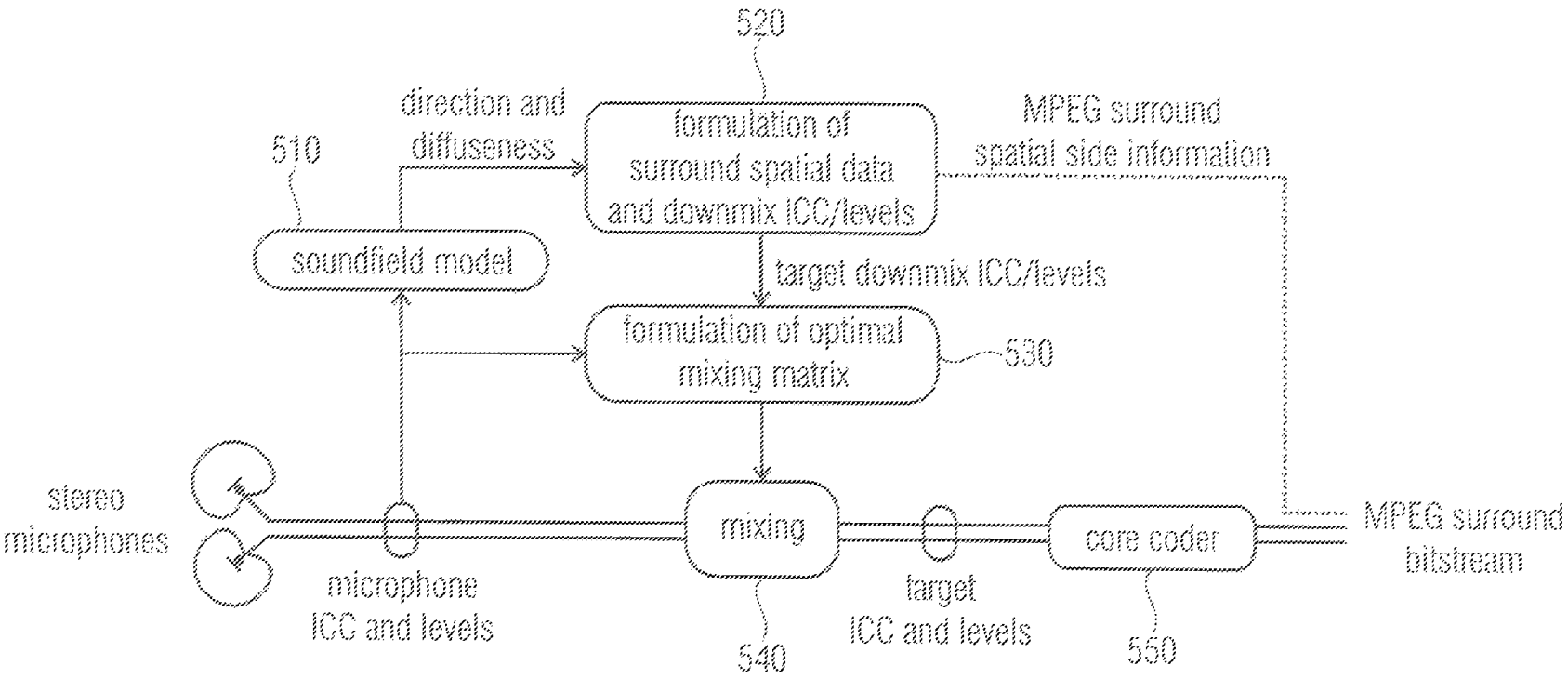
FIG. 5 shows a diagram which depicts a stereo coincidence microphone signal to MPEG Surround encoder according to an embodiment.

In FIG. 5, a diagram is illustrated which depicts a stereo coincidence microphone signal to MPEG Surround encoder according to an embodiment, which employs the proposed concept to create the MPEG Surround downmix signal from the given microphone signal. All processing is performed in frequency bands.

A spatial data determination module 520 is adapted to formulate configuration information data comprising spatial surround data and downmix ICC and/or levels based on direction and diffuseness information depending on a sound field model 510. The soundfield model itself is based on an analysis of microphone ICCs and levels of a stereo microphone signal. The spatial data determination module 520 then provides the target downmix ICCs and levels to a mixing matrix formulation module 530. Furthermore, the spatial data determination module 520 may be adapted to formulate spatial surround data and downmix ICCs and levels as MPEG Surround spatial side information. The mixing matrix formulation module 530 then formulates a mixing matrix based on the provided configuration information data, e.g. target downmix ICCs and levels, and feeds the matrix into a mixing module 540. The mixing module 540 applies the mixing matrix on the stereo microphone signal. By this, a signal is generated having the target ICCs and levels. The signal with the target ICCs and levels is then provided to a core coder 550. In an embodiment, the modules 520, 530 and 540 are submodules of a signal processor.

Within the process conducted by an apparatus according to FIG. 5, an MPEG Surround stereo downmix is generated. This includes a need for adjusting the levels and the ICCs of the given stereo signal with minimum impact to the sound quality. The proposed cross-mixing concept was applied for this purpose and the perceptual benefit of conventional technology in [3] was observable.

Figure 6:
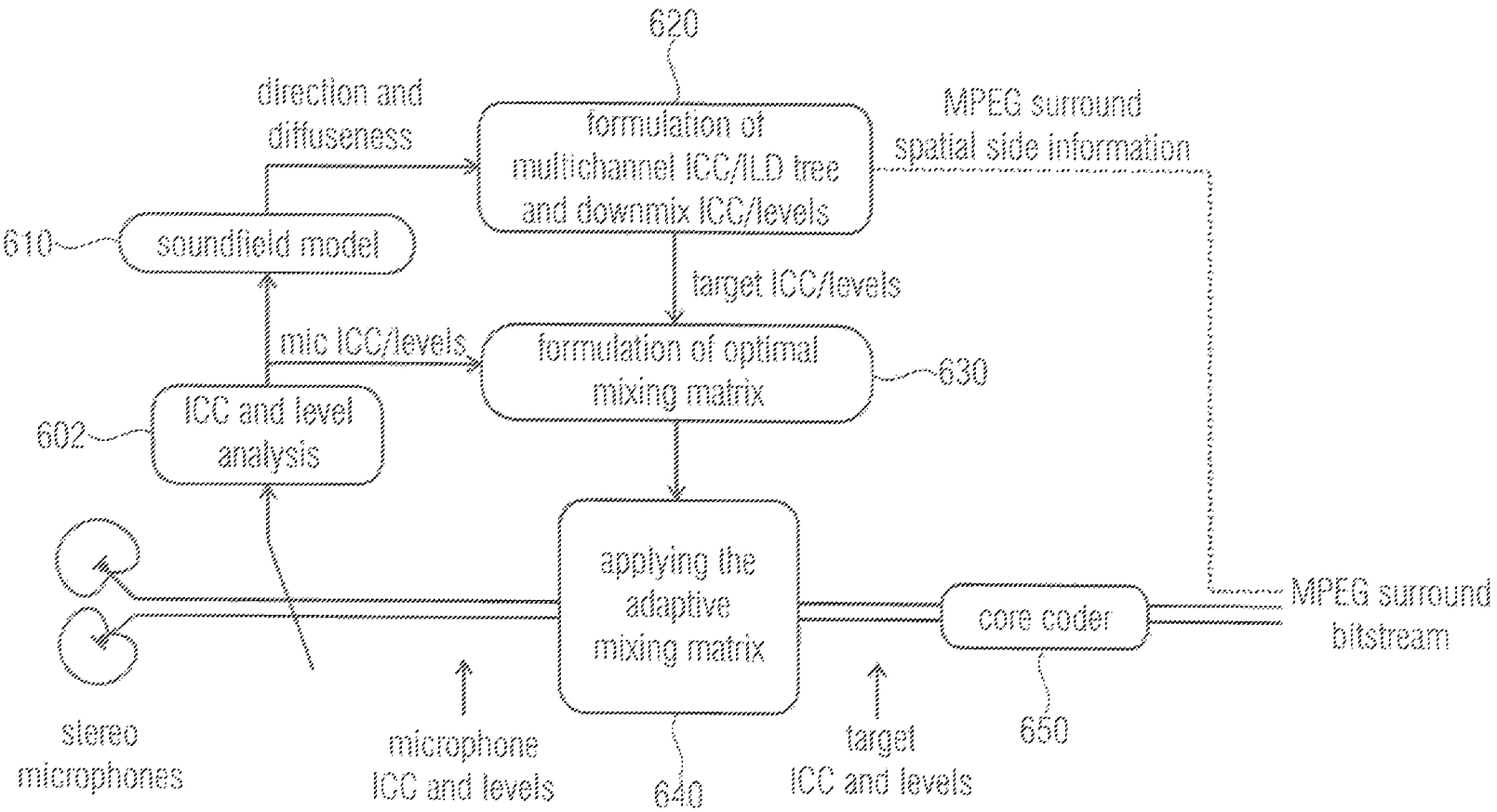
FIG. 6 depicts an apparatus according to another embodiment relating to downmix ICC/level correction for a SAM-to-MPS encoder.

FIG. 6 illustrates an apparatus according to another embodiment relating to downmix ICC/level correction for a SAM-to-MPS encoder. An ICC and level analysis is conducted in module 602 and the soundfield model 610 depends on the ICC and level analysis by module 602. Module 620 corresponds to module 520, module 630 corresponds to module 530 and module 640 corresponds to module 540 of FIG. 5, respectively. The same applies for the core coder 650 which corresponds to the core coder 550 of FIG. 5. The above-described concept may be integrated into a SAM-to-MPS encoder to create from the microphone signals the MPS downmix with exactly correct ICC and levels. The above described concept is also applicable in direct SAM-to-multichannel rendering without MPS in order to provide ideal spatial synthesis while minimizing the amount of decorrelator usage.

Improvements are expected with respect to source distance, source localization, stability, listening comfortability and envelopment.

Figure 7:
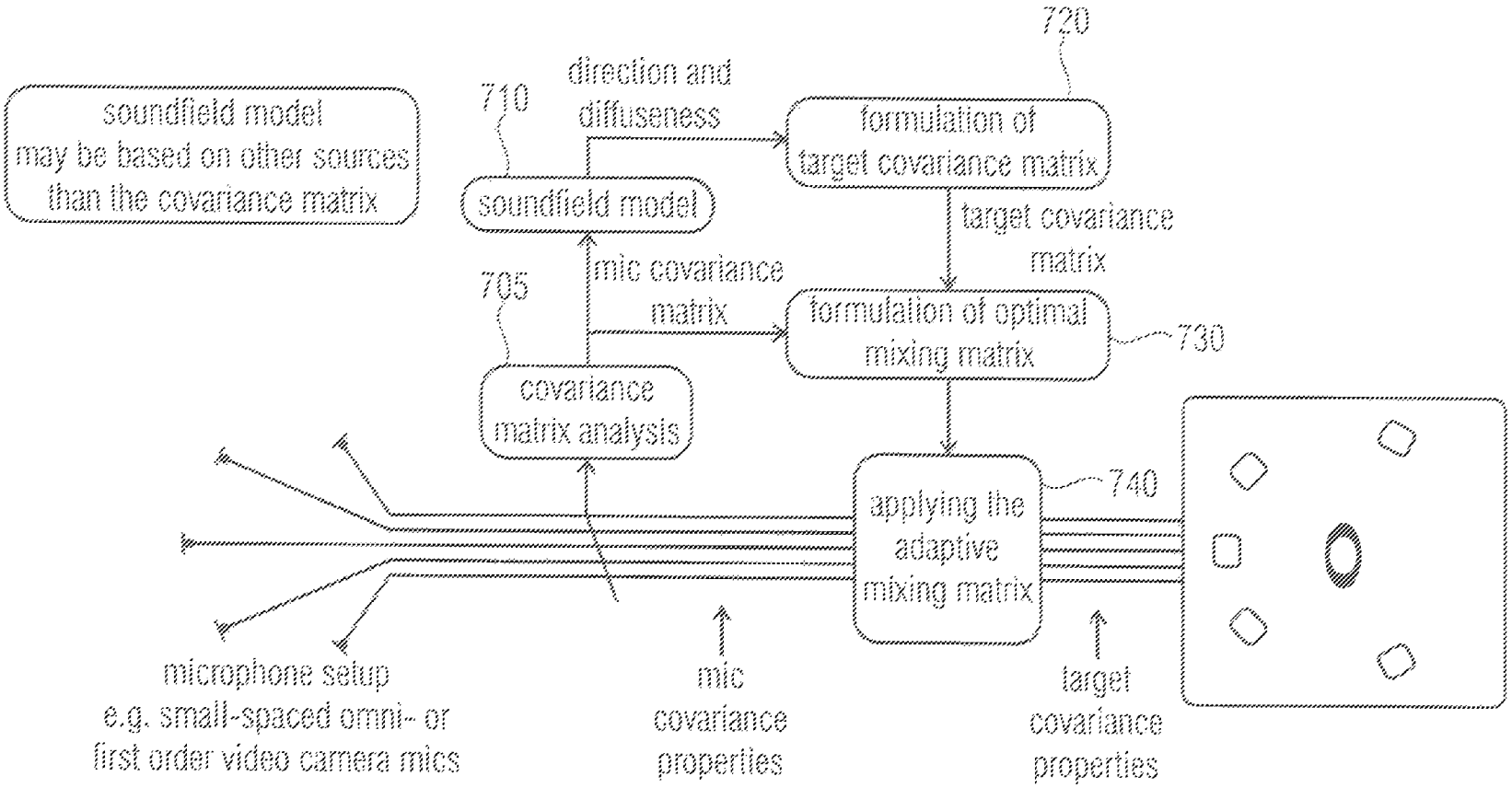
FIG. 7 depicts an apparatus according to an embodiment for an enhancement for small spaced microphone arrays.

FIG. 7 depicts an apparatus according to an embodiment for an enhancement for small spaced microphone arrays. A module 705 is adapted to conduct a covariance matrix analysis of a microphone input signal to obtain a microphone covariance matrix. The microphone covariance matrix is fed into a mixing matrix formulation module 730. Moreover, the microphone covariance matrix is used to derive a soundfield model 710. The soundfield model 710 may be based on other sources than the covariance matrix.

Direction and diffuseness information based on the soundfield model is then fed into a target covariance matrix formulation module 720 for generating a target covariance matrix. The target covariance matrix formulation module 720 then feeds the generated target covariance matrix into the mixing matrix formulation module 730.

The mixing matrix formulation module 730 is adapted to generate the mixing matrix and feeds the generated mixing matrix into a mixing matrix application module 740. The mixing matrix application module 740 is adapted to apply the mixing matrix on the microphone input signal to obtain a microphone output signal having the target covariance properties. In an embodiment, the modules 720, 730 and 740 are submodules of a signal processor.

Such an apparatus follows the concept in DirAC and SAM, which is to estimate the direction and diffuseness of the original sound field and to create such output that best reproduces the estimated direction and diffuseness. This signal processing procedure involves large covariance matrix adjustments in order to provide the correct spatial image. The processed concept is the solution to it. By the proposed concept, the source distance, source localization and/or source separation, listening comfortability and/or envelopment.

Figure 8:
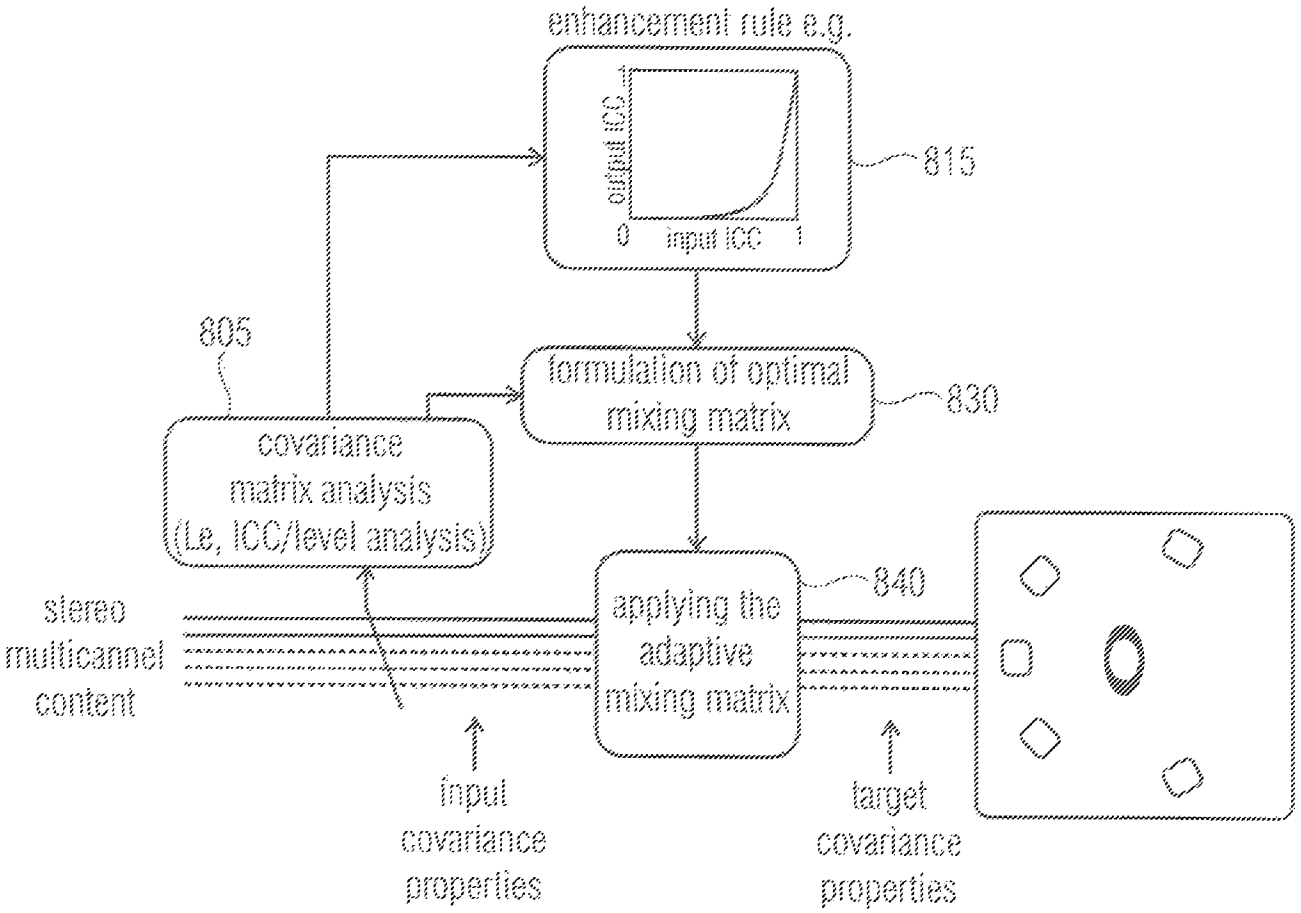
FIG. 8 illustrates an apparatus according to another embodiment for blind enhancement of the spatial sound quality in stereo- or multichannel playback.

FIG. 8 illustrates an example which shows an embodiment for blind enhancement of the spatial sound quality in stereo- or multichannel playback. In module 805, a covariance matrix analysis, e.g. an ICC or level analysis of stereo or multichannel content is conducted. Then, an enhancement rule is applied in enhancement module 815, for example, to obtain output ICCs from input ICCs. A mixing matrix formulation module 830 generates a mixing matrix based on the covariance matrix analysis conducted by module 805 and based on the information derived from applying the enhancement rule which was conducted in enhancement module 815. The mixing matrix is then applied on the stereo or multichannel content in module 840 to obtain adjusted stereo or multichannel content having the target covariance properties.

Regarding multichannel sound, e.g., mixes or recordings, it is fairly common to find perceptual suboptimality in spatial sound, especially in terms of too high ICC. A typical consequence is reduced quality with respect to width, envelopment, distance, source separation, source localization and/or source stability and listening comfortability. It has been tested informally that the concept is able to improve these properties with items that have unnecessarily high ICCs. Observed improvements are width, source distance, source localization/separation, envelopment and listening comfortability.

Figure 9:
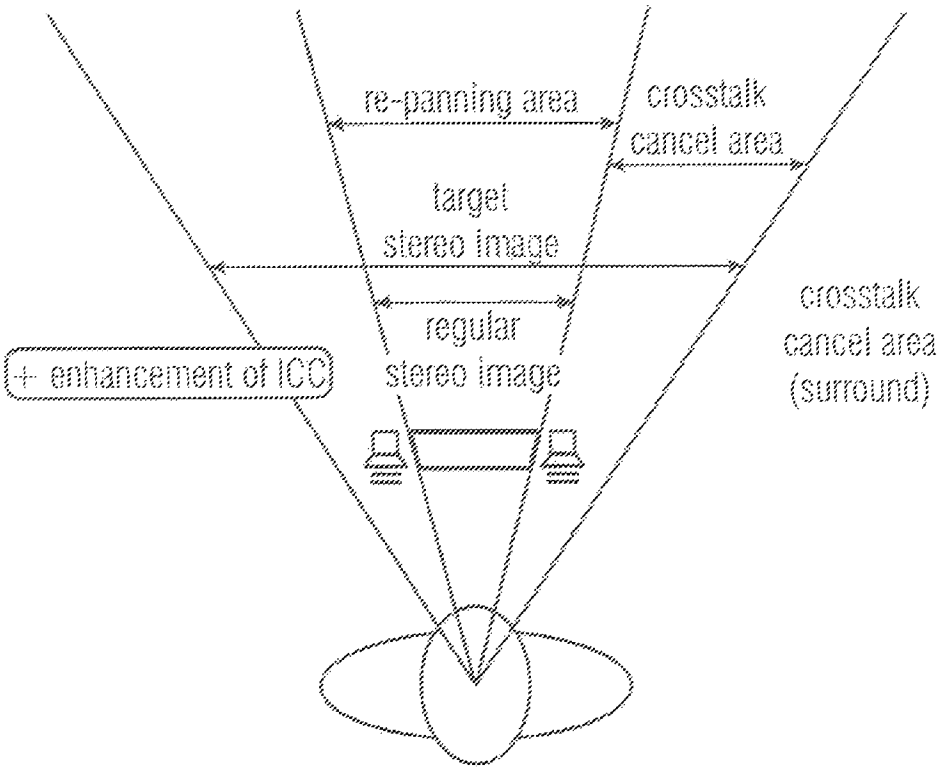
FIG. 9 illustrates enhancement of narrow loudspeaker setups.

FIG. 9 illustrates another embodiment for enhancement of narrow loudspeaker setups (e.g., tablets, TV). The proposed concept is likely beneficial as a tool for improving stereo quality in playback setups where a loudspeaker angle is too narrow (e.g., tablets). The proposed concept will provide:

- repanning of sources within the given arc to match a wider loudspeaker setup
- increase the ICC to better match that of a wider loudspeaker setup
- provide a better starting point to perform crosstalk-cancellation, e.g., using crosstalk cancellation only when there is no direct way to create the desired binaural cues.

Improvements are expected with respect to width and with respect to regular crosstalk cancel, sound quality and robustness.

Figure 10:
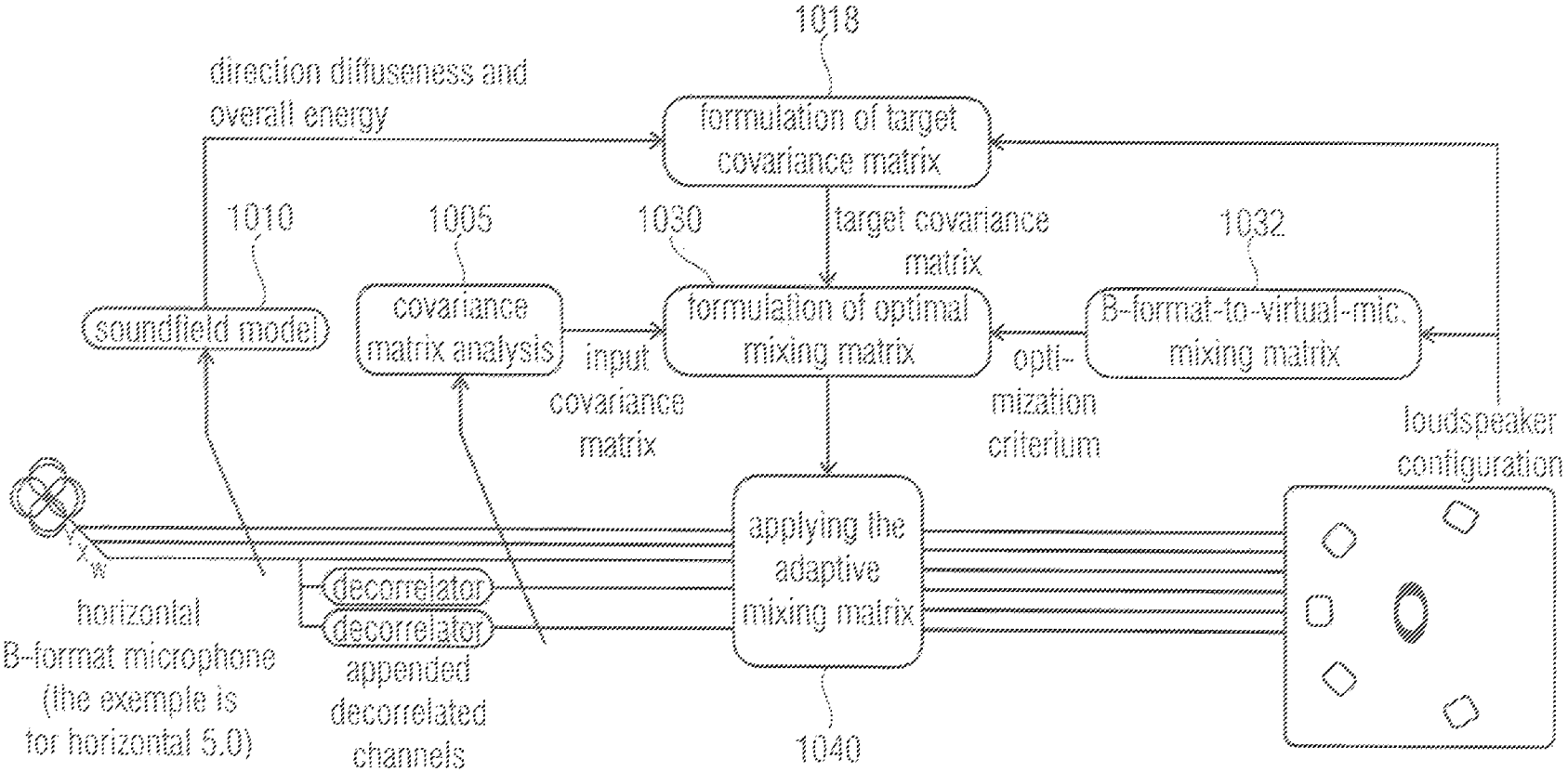
FIG. 10 depicts an embodiment providing improved Directional Audio Coding rendering based on a B-format microphone signal.

In another application example illustrated by FIG. 10, an embodiment is depicted providing optimal Directional Audio Coding (DirAC) rendering based on a B-format microphone signal.

The embodiment of FIG. 10 is based on the finding that state-of-the-art DirAC rendering units based on coincident microphone signals apply the decorrelation in unnecessary extent, thus, compromising the audio quality. For example, if the sound field is analyzed diffuse, full correlation is applied on all channels, even though a B-format provides already three incoherent sound components in case of a horizontal sound field (W, X, Y). This effect is present in varying degrees except when diffuseness is zero.

Furthermore, the above-described systems using virtual microphones do not guarantee correct output covariance matrix (levels and channel correlations) because the virtual microphones effect the sound differently depending on source angle, loudspeaker positioning and sound field diffuseness.

The proposed concept solves both issues. Two alternatives exist: providing decorrelated channels as extra input channels (as in the figure below); or using a decorrelator-mixing concept.

In FIG. 10, a module 1005 conducts a covariance matrix analysis. A target covariance matrix formulation module 1018 takes not only a soundfield model, but also a loudspeaker configuration into account when formulating a target covariance matrix. Furthermore, a mixing matrix formulation module 1030 generates a mixing matrix not only based on a covariance matrix analysis and the target covariance matrix, but also based on an optimization criterion, for example, a B-format-to-virtual microphone mixing matrix provided by a module 1032. The soundfield model 1010 may correspond to the soundfield model 710 of FIG. 7. The mixing matrix application module 1040 may correspond to the mixing matrix application module 740 of FIG. 7.

In a further application example, an embodiment is provided for spatial adjustment in channel conversion methods, e.g., downmix. The channel conversion, e.g., making automatic 5.1 downmix out of 22.2 audio track includes collapsing channels. This may include a loss or change of the spatial image which may be addressed with the proposed concept. Again, two alternatives exist: The first one utilizes the concept in the domain of the higher number of channels but defining zero-energy channels for the missing channels of the lower number; the other one formulates the matrix solution directly for different channel numbers.

FIGS. 11A to 11C illustrate table 1, which provides numerical examples of the above-described concepts. When a signal with covariance $C_x$ is processed with a mixing matrix M and complemented with a possible residual signal with $C_r$, the output signal has covariance $C_y$. Although these numerical examples are static, the typical use case of the proposed method is dynamic. The channel order is assumed L, R, C, Ls, Rs, (Lr, Rr).

Table 1 shows a set of numerically examples to illustrate the behavior of the proposed concept in some expected use cases. The matrices were formulated with the Matlab code provided in listing 1. Listing 1 is illustrated in FIGS. 12A and 12B.

Listing 1 of FIGS. 12A and 12B illustrates a Matlab implementation of the proposed concept. The Matlab code was used in the numerical examples and provides the general functionality of the proposed concept.

Although the matrices are illustrated static, in typical applications they vary in time and frequency. The design criterion is by definition met that if a signal with covariance $C_x$ is processed with a mixing matrix M and completed with a possible residual signal with $C_r$ the output signal has the defined covariance $C_y$.

The first and the second row of the table illustrate a use case of stereo enhancement by means of decorrelating the signals. In the first row there is a small but reasonable incoherent component between the two channels and thus fully incoherent output is achieved with only channel mixing. In the second row, the input correlation is very high, e.g., the smaller principle component is very small. Amplifying this in extreme degrees is not desirable and thus the built-in limiter starts to entail injection of the correlated energy instead, e.g., $C_r$ is now non-zero.

The third row shows a case of stereo to 5.0 upmixing. In this example, the target covariance matrix is set so that the incoherent component of the stereo mix is equally and incoherently distributed to side and rear loudspeakers and the coherent component is placed to the central loudspeaker. The residual signal is again non-zero since the dimension of the signal is increased.

The fourth row shows a case of simple 5.0 to 7.0 upmixing where the original two rear channels are upmixed to the four new rear channels, incoherently. This example illustrates that the processing focuses on those channels where adjustments are requested.

The fifth row depicts a case of downmixing a 5.0 signal to stereo. Passive downmixing, such as applying a static downmixing matrix Q, would amplify the coherent components over the incoherent components. Here the target covariance matrix was defined to preserve the energy, which is fulfilled by the resulting M.

The sixth and seventh row illustrate the use case of coincident spatial microphony. The input covariance matrices $C_x$ are the result of placing ideal first order coincident microphones to an ideal diffuse field. In the sixth row the angles between the microphones are equal, and in the seventh row the microphones are facing towards the standard angles of a 5.0 setup. In both cases, the large off-diagonal values of $C_x$ illustrate the inherent disadvantage of passive first order coincident microphone techniques in the ideal case, the covariance matrix best representing a diffuse field is diagonal, and this was therefore set as the target. In both cases, the ratio of resulting the correlated energy over all energy is exactly 2/5. This is because there are three independent signal components available in the first order horizontal coincident microphone signals, and two are to be added in order to reach the five-channel diagonal target covariance matrix.

The spatial perception in stereo and multichannel playback has been identified to depend especially on the signal covariance matrix in the perceptually relevant frequency bands.

A concept to control the covariance matrix of a signal by optimal crossmixing of the channels has been presented. Means to inject decorrelated energy where useful in cases when enough independent signal components of reasonable energy are not available have been presented.

The concept has been found robust in its purpose and a wide variety of likely applications have been identified.

In the following, embodiments are presented, how to generate $C_y$ based on $C_x$. As a first example, Stereo to 5.0 upmixing is considered. Regarding stereo-to-5.0 upmixing, in upmixing, $C_x$ is a 2×2 matrix and $C_y$ is a 5×5 matrix (in this example, the subwoofer channel is not considered). The steps to generate $C_y$ based on $C_x$, in each time-frequency tile, in context of upmixing, may, for example, be as follows:

1. Estimate the ambient and direct energy in the left and right channel. Ambience is characterized by an incoherent component between the channels which has equal energy in both channels. Direct energy is the remainder when the ambience energy portion is removed from the total energy, e.g. the coherent energy component, possibly with different energies in the left and right channels.

2. Estimate an angle of the direct component. This is done by using an amplitude panning law inversely. There is an amplitude panning ratio in the direct component, and there is only one angle between the front loudspeakers which corresponds to it.

3. Generate a 5×5 matrix of zeros as $C_y$.

4. Place the amount of direct energy to the diagonal of $C_y$ corresponding to two nearest loudspeakers of the analyzed direction. The distribution of the energy between these can be acquired by the amplitude panning laws. Amplitude panning is coherent, so add to the corresponding non-diagonal the square root of the product of the energies of the two channels.

5. Add to the diagonal of $C_y$, corresponding to channels L, R, Ls and Rs, the amount of energy that corresponds to the energy of the ambience component. Equal distribution is a good choice. Now one has the target $C_y$.

As another example, enhancement is considered. It is aimed to increase perceptual qualities such as width or envelopment by adjusting the interchannel coherence towards zero. Here, two different examples are given, in two ways to perform the enhancement. For the first way, one selects a use case of stereo enhancement, so Cx and Cy are 2×2 matrices. The steps are as follows:

1. Formulate ICC (the normalized covariance value between −1 and 1, e.g. with the formula provided.

2. Adjust ICC by a function. E.g. $ICC_{new}$=sign(ICC) *$ICC^2$. This is a quite mild adjustment. Or $ICC_{new}$=sign (ICC)*max(0, abs(ICC)*10−9). This is a larger adjustment.

3. Formulate $C_y$ so that the diagonal values are the same as in $C_x$, but the non-diagonal value is formulated using $ICC_{new}$, with the same formula as in step 1, but inversely.

In the above scenario, the residual signal is not needed, since the ICC adjustment is designed so that the system does not request large amplification of small signal components.

The second type of implementing the method in this use case, is as follows. One has an N channel input signal, so $C_x$ and $C_y$ are N×N matrices.

1. Formulate $C_y$ from $C_x$ by simply setting the diagonal values in $C_y$ the same as in $C_x$, and the non-diagonal values to zero.

2. Enable the gain-compensating method in the proposed method, instead of using the residuals. The regularization in the inverse of $K_x$ takes care that the system is stable. The gain compensation takes care that the energies are preserved.

The two described ways to do enhancement provide similar results. The latter is easier to implement in the multi-channel use case.

Finally, as a third example, the Direct/diffuseness model, for example Directional Audio Coding (DirAC), is considered DirAC, and also Spatial Audio Microphones (SAM), provide an interpretation of a sound field with parameters direction and diffuseness. Direction is the angle of arrival of the direct sound component. Diffuseness is a value between 0 and 1, which gives information how large amount of the total sound energy is diffuse, e.g. assumed to arrive incoherently from all directions. This is an approximation of the sound field, but when applied in perceptual frequency bands, a perceptually good representation of the sound field is provided. The direction, diffuseness, and the overall energy of the sound field known are assumed in a time-frequency tile. These are formulated using information in the microphone covariance matrix $C_x$. One has an N channel loudspeaker setup. The steps to generate $C_y$ are similar to upmixing, as follows:

1. Generate a N×N matrix of zeros as $C_y$.

2. Place the amount of direct energy, which is (1−diffuseness)*total energy, to the diagonal of $C_y$ corresponding to two nearest loudspeakers of the analyzed direction. The distribution of the energy between these can be acquired by amplitude panning laws. Amplitude panning is coherent, so add to the corresponding non-diagonal a square root of the products of the energies of the two channels.

3. Distribute to the diagonal of $C_y$ the amount of diffuse energy, which is diffuseness*total energy. The distribution can be done e.g. so that more energy is placed to those directions where the loudspeakers are sparse. Now one has the target $C_y$.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

LITERATURE

[1] C. Faller, "Multiple-Loudspeaker Playback of Stereo Signals", Journal of the Audio Engineering Society, Vol. 54, No. 11, pp. 1051-1064, June 2006.

[2] V. Pulkki, "Spatial Sound Reproduction with Directional Audio Coding", Journal of the Audio Engineering Society, Vol. 55, No. 6, pp. 503-516, June 2007.

[3] C. Tournery, C. Faller, F. Küch, J. Herre, "Converting Stereo Microphone Signals Directly to MPEG Surround", 128th AES Convention, May 2010.

[4] J. Breebaart, S. van de Par, A. Kohlrausch and E. Schuijers, "Parametric Coding of Stereo Audio," EURASIP Journal on Applied Signal Processing, Vol. 2005, No. 9, pp. 1305-1322, 2005.

[5] J. Herre, K. Kjörling, J. Breebaart, C. Faller, S. Disch, H. Purnhagen, J. Koppens, J. Hilpert, J. Rödén, W. Oomen, K. Linzmeier and K. S. Chong, "MPEG Surround—The ISO/MPEG Standard for Efficient and Compatible Multichannel Audio Coding", Journal of the Audio Engineering Society, Vol. 56, No. 11, pp. 932-955, November 2008.

[6] J. Vilkamo, V. Pulkki, "Directional Audio Coding: Virtual Microphone-Based Synthesis and Subjective Evaluation", Journal of the Audio Engineering Society, Vol. 57, No. 9, pp. 709-724, September 2009.

[7] Golub, G. H. and Van Loan, C. F., "Matrix computations", Johns Hopkins Univ Press, 1996.

[8] R. Rebonato, P. Jäckel, "The most general methodology to create a valid correlation matrix for risk management and option pricing purposes", Journal of Risk, Vol. 2, No. 2, pp. 17-28, 2000.

The invention claimed is:

1. An apparatus for generating an audio output signal from an audio input signal comprising two or more audio input channels, wherein the apparatus comprises a signal processor for generating the audio output signal by applying a mixing rule on at least two of the two or more audio input channels, wherein the signal processor is configured to determine the mixing rule based on first covariance properties of the audio input signal and based on second covariance properties of the audio output signal, the second covariance properties being different from the first covariance properties, the second covariance properties being target covariance properties, wherein the apparatus is implemented using a hardware apparatus or using a computer or using a combination of a hardware apparatus and a computer.

2. The apparatus according to claim 1, wherein the apparatus comprises a provider for providing first covariance properties of the audio input signal, and wherein the provider is configured to provide the first covariance properties, wherein the first covariance properties comprise a first state for a first time-frequency bin, and wherein the first covariance properties comprise a second state, being different from the first state, for a second time-frequency bin, being different from the first time-frequency bin.

3. The apparatus according to claim 1, wherein the signal processor is configured to determine the mixing rule based on the second covariance properties, wherein the second covariance properties comprise a third state for a third time-frequency bin, and wherein the second covariance properties comprise a fourth state, being different from the third state for a fourth time-frequency bin, being different from the third time-frequency bin.

4. The apparatus according to claim 1, wherein the audio output signal comprises two or more audio output channels, wherein the signal processor is configured to generate the audio output signal by applying the mixing rule such that each one of the two or more audio output channels depends on each one of the two or more audio input channels.

5. The apparatus according to claim 1, wherein the signal processor is configured to determine the mixing rule such that an error measure is minimized.

6. The apparatus according to claim 5, wherein the signal processor is configured to determine the mixing rule such that the mixing rule depends on $$\|y_{ref}-y\|^2$$

wherein $$y_{ref}=Qx,$$

wherein x is the audio input signal, wherein Q is a mapping matrix, and wherein y is the audio output signal.

7. The apparatus according to claim 1, wherein the signal processor is configured to determine the mixing rule by determining the second covariance properties, wherein the signal processor is configured to determine the second covariance properties based on the first covariance properties.

8. The apparatus according to claim 1, wherein the signal processor is configured to determine a mixing matrix as the mixing rule, wherein the signal processor is configured to determine the mixing matrix based on the first covariance properties and based on the second covariance properties.

9. The apparatus according to claim 2, wherein the provider is configured to provide the first covariance properties by determining a first covariance matrix of the audio input signal, and wherein the signal processor is configured to determine the mixing rule based on a second covariance matrix of the audio output signal as the second covariance properties.

10. The apparatus according to claim 9, wherein the provider is configured to determine the first covariance matrix, such that each diagonal value of the first covariance matrix indicates an energy of one of the audio input channels, and such that each value of the first covariance matrix, which is not a diagonal value indicates an inter-channel correlation between a first audio input channel and a different second audio input channel.

11. The apparatus according to claim 9, wherein the audio output signal comprises two or more audio output channels, wherein the signal processor is configured to determine the mixing rule based on the second covariance matrix, wherein each diagonal value of the second covariance matrix indicates an energy of one of the audio output channels, and wherein each value of the second covariance matrix, which is not a diagonal value, indicates an inter-channel correlation between a first audio output channel and a second audio output channel.

12. The apparatus according to claim 2, wherein the signal processor is configured to determine a mixing matrix as the mixing rule, wherein the signal processor is configured to determine the mixing matrix based on the first covariance properties and based on the second covariance properties, wherein the provider is configured provide the first covariance properties by determining a first covariance matrix of the audio input signal, and wherein the signal processor is configured to determine the mixing rule based on a second covariance matrix of the audio output signal as the second covariance properties, wherein the signal processor is configured to determine the mixing matrix such that:

$$M=K_yPK_x^{-1},$$

such that $$K_xK_x^T=C_x,$$

$$K_yK_y^T=C_y$$

wherein M is the mixing matrix, wherein $C_x$ is the first covariance matrix, wherein $C_y$ is the second covariance matrix, wherein $K_x^T$ is a first transposed matrix of a first decomposed matrix $K_x$, wherein $K_y^T$ is a second transposed matrix of a second decomposed matrix $K_y$, wherein $K_x^{-1}$ is an inverse matrix of the first decomposed matrix $K_x$, and wherein P is a first unitary matrix.

13. The apparatus according to claim 12, wherein the signal processor is configured to determine the mixing matrix such that $$M=K_yPK_x^{-1},$$

wherein $$P=V\Lambda U^T,$$

wherein $U^T$ is a third transposed matrix of a second unitary matrix U, wherein V is a third unitary matrix, wherein Λ is an identity matrix appended with zeros, wherein $$USV^T=K_x^TQ^TK_y,$$

wherein $Q^T$ is a fourth transposed matrix of the mapping matrix Q, wherein $V^T$ is a fifth transposed matrix of the third unitary matrix V, and wherein S is a diagonal matrix.

14. The apparatus according to claim 2, wherein the signal processor is configured to determine a mixing matrix as the mixing rule, wherein the signal processor is configured to determine the mixing matrix based on the first covariance properties and based on the second covariance properties, wherein the provider is configured to provide the first covariance properties by determining a first covariance matrix of the audio input signal, and wherein the signal processor is configured to determine the mixing rule based on a second covariance matrix of the audio output signal as the second covariance properties, wherein the signal processor is configured to determine the mixing rule by modifying at least some diagonal values of a diagonal matrix $S_x$ when the values of the diagonal matrix $S_x$ are zero or smaller than a threshold value, such that the values are greater than or equal to the threshold value, wherein the diagonal matrix depends on the first covariance matrix.

15. The apparatus according to claim 14, wherein the signal processor is configured to modify the at least some diagonal values of the diagonal matrix $S_x$, wherein $K_x=U_xS_xV_x^T$, and wherein $C_x=K_xK_x^T$, wherein $C_x$ is the first covariance matrix, wherein $S_x$ is the diagonal matrix, wherein $U_x$ is a second matrix, $V_x^T$ is a third transposed matrix, and wherein $K_x^T$ is a fourth transposed matrix of the fifth matrix $K_x$, and wherein $V_x$ and $U_x$ are unitary matrices.

16. The apparatus according to claim 14, wherein the signal processor is configured to generate the audio output signal by applying the mixing matrix on at least two of the two or more audio input channels to acquire an intermediate signal and by adding a residual signal r to the intermediate signal to acquire the audio output signal.

17. The apparatus according to claim 14, wherein the signal processor is configured to determine the mixing matrix based on a diagonal gain matrix G and an intermediate matrix $\hat{M}$, such that $M'=G\hat{M}$, wherein the diagonal gain matrix comprises the value $$G(i,i)=\sqrt{\frac{C_y(i,i)}{\hat{C}_y(i,i)}}$$

where $\hat{C}_y=\hat{M}C_x\hat{M}^T$, wherein M' is the mixing matrix, wherein G is the diagonal gain matrix, wherein $C_y$ is the second covariance matrix and wherein $\hat{M}^T$ is a fifth transposed matrix of the intermediate matrix $\hat{M}$.

18. The apparatus according to claim 2, wherein the signal processor comprises:

a mixing matrix formulation module for generating a mixing matrix as the mixing rule based on the first covariance properties, and a mixing matrix application module for applying the mixing matrix on the audio input signal to generate the audio output signal.

19. The apparatus according to claim 18, wherein the provider comprises a covariance matrix analysis module for providing input covariance properties of the audio input signal to acquire an analysis result as the first covariance properties, and wherein the mixing matrix formulation module is configured to generate the mixing matrix based on the analysis result.

20. The apparatus according to claim 18, wherein the mixing matrix formulation module is configured to generate the mixing matrix based on an error criterion.

21. The apparatus according to claim 18, wherein the signal processor further comprises a spatial data determination module for determining configuration information data comprising surround spatial data, inter-channel correlation data or audio signal level data, and wherein the mixing matrix formulation module is configured to generate the mixing matrix based on the configuration information data.

22. The apparatus according to claim 19, wherein the signal processor furthermore comprises a target covariance matrix formulation module for generating a target covariance matrix based on the analysis result, and wherein the mixing matrix formulation module is configured to generate a mixing matrix based on the target covariance matrix.

23. The apparatus according to claim 22, wherein the target covariance matrix formulation module is configured to generate the target covariance matrix based on a loudspeaker configuration.

24. The apparatus according to claim 18, wherein the signal processor further comprises an enhancement module for acquiring output inter-channel correlation data based on input inter-channel correlation data, being different from the input inter-channel correlation data, and wherein the mixing matrix formulation module is configured to generate the mixing matrix based on the output inter-channel correlation data.

25. A method for generating an audio output signal from an audio input signal comprising two or more audio input channels, wherein the method comprises generating the audio output signal by applying a mixing rule on at least two of the two or more audio input channels, wherein the method comprises determining the mixing rule based on first covariance properties of the audio input signal and depending based on second covariance properties of the audio output signal, the second covariance properties being different from the first covariance properties, the second covariance properties being target covariance properties, wherein the method is performed using a hardware apparatus or using a computer or using a combination of a hardware apparatus and a computer.

26. A non-transitory computer-readable medium comprising a computer program for implementing the method of claim 25 when being executed on a computer or processor.

* * * * *